US008382241B2

(12) United States Patent
Saitoh et al.

(10) Patent No.: US 8,382,241 B2
(45) Date of Patent: Feb. 26, 2013

(54) IMAGE FORMING APPARATUS PERFORMING NON-PRINTING DISCHARGE

(75) Inventors: Atsushi Saitoh, Kanagawa (JP); Manabu Izumikawa, Tokyo (JP); Kazumi Kobayashi, Tokyo (JP); Shiho Shimosaka, Tokyo (JP); Shingo Shiramura, Kanagawa (JP); Shohgo Takeuchi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 106 days.

(21) Appl. No.: 13/047,987

(22) Filed: Mar. 15, 2011

(65) Prior Publication Data

US 2011/0227980 A1 Sep. 22, 2011

(30) Foreign Application Priority Data

Mar. 16, 2010 (JP) ..... 2010-059604
Jan. 25, 2011 (JP) ..... 2011-013430

(51) Int. Cl.
*B41J 2/165* (2006.01)

(52) U.S. Cl. ..... 347/35; 347/16

(58) Field of Classification Search ..... 347/16, 347/35

See application file for complete search history.

(56) References Cited

U.S. PATENT DOCUMENTS

2006/0132572 A1* 6/2006 Mochizuki et al. ..... 347/104
2010/0091056 A1 4/2010 Miyagi et al.

FOREIGN PATENT DOCUMENTS

| | | |
|---|---|---|
| JP | 2006-143411 | 6/2006 |
| JP | 2007-015193 | 1/2007 |
| JP | 2007-168277 | 7/2007 |
| JP | 2009-111909 | 5/2009 |
| JP | 2010-094814 | 4/2010 |

* cited by examiner

*Primary Examiner* — Julian Huffman
(74) *Attorney, Agent, or Firm* — IPUSA, PLLC

(57) ABSTRACT

An image forming apparatus includes a recording head having nozzles to form an image by squirting droplets onto a recording medium, a transfer member transferring the recording medium and having holes which allows passage of droplets squirted by the recording head for non-printing discharge, an area detecting unit to detect a plurality of non-printing discharge areas that are areas between adjacent recording media, and a non-printing discharge instructing unit to cause the nozzles to perform non-printing discharge such that all the nozzles perform non-printing discharge at least once in the non-printing discharge areas.

9 Claims, 31 Drawing Sheets

FIG.11

| T2 | NON-PRINTING DISCHARGE DATA |
|---|---|
| ( 4/16)T3 | DATA STARTING WITH LINE A1 |
| ( 5/16)T3 | DATA STARTING WITH LINE B1 |
| ( 6/16)T3 | DATA STARTING WITH LINE A2 |
| ( 7/16)T3 | DATA STARTING WITH LINE B2 |
| ( 8/16)T3 | DATA STARTING WITH LINE A3 |
| ( 9/16)T3 | DATA STARTING WITH LINE B3 |
| (10/16)T3 | DATA STARTING WITH LINE A4 |
| (11/16)T3 | DATA STARTING WITH LINE B4 |
| (12/16)T3 | DATA STARTING WITH LINE A5 |
| (13/16)T3 | DATA STARTING WITH LINE B5 |
| (14/16)T3 | DATA STARTING WITH LINE A6 |
| (15/16)T3 | DATA STARTING WITH LINE B6 |
| (16/16)T3 | DATA STARTING WITH LINE A7 |
| (17/16)T3 | DATA STARTING WITH LINE B7 |
| (18/16)T3 | DATA STARTING WITH LINE A8 |
| (19/16)T3 | DATA STARTING WITH LINE B8 |

FIG.17

| | |
|---|---|
| NON-PRINTING DISCHARGE AREA A | : H1,H2,H3 |
| NON-PRINTING DISCHARGE AREA B | : H4 |
| NON-PRINTING DISCHARGE AREA C | : H5 |

FIG.18

| | |
|---|---|
| NON-PRINTING DISCHARGE AREA A | : H3 |
| NON-PRINTING DISCHARGE AREA B | : H2, H4 |
| NON-PRINTING DISCHARGE AREA C | : H1, H5 |

FIG.19

| | |
|---|---|
| NON-PRINTING DISCHARGE AREA A | : H1,H2,H3 |
| NON-PRINTING DISCHARGE AREA B | : H2,H3,H4 |
| NON-PRINTING DISCHARGE AREA C | : H1, H4,H5 |

IMAGE FORMING APPARATUS PERFORMING NON-PRINTING DISCHARGE

BACKGROUND OF THE INVENTION

1. Field of the Invention

The disclosures herein relate to an image forming apparatus.

2. Description of the Related Art

A liquid-jet-type image forming apparatus squirts ink from print head nozzles onto a print sheet transferred by a transfer belt to perform printing. In such an image forming apparatus, it may be desirable to prevent the print head nozzles from drying, thereby maintaining proper ink squirt conditions. There is an inkjet-type image forming apparatus that periodically performs an action of squirting ink (i.e., non-printing discharge) from nozzles on a mandatory basis toward areas outside a print sheet (see Japanese Patent Application Publication No. 2009-111909, for example). Such an action may be performed between print sheets during a print operation or on a print sheet.

In a conventional flushing system, non-printing discharge from all the nozzles is directed toward a hole provided in the transfer belt. Specifically, non-printing discharge for all the nozzles is performed between two adjacent print sheets. If the space between two adjacent print sheets is not as large as the area size required for the non-printing discharge of all the nozzles, non-printing discharge is not performed.

In order to perform non-printing discharge between print sheets in the most efficient manner, all the nozzles of all the heads may perform non-printing discharge at a single space between two print sheets. To this end, however, the hole in the transfer belt may need to be enlarged. Alternatively, non-printing discharge may be performed between paper sheets by shortening the intervals of holes provided in the transfer belt. Such an arrangement for efficient non-printing discharge attained by modifying a transfer belt, however, may result in the strength of the belt being lowered. Also, the adherence of a print sheet to the belt on the travel path may be weakened. Moreover, the performance of an image forming apparatus may be further improved to shorten the intervals of print sheets. In such a case, efficient non-printing discharge can no longer be performed.

Accordingly, it may be preferable to provide an image forming apparatus that can perform efficient non-printing discharge even if the intervals of recording media (e.g., print sheets) are shortened.

SUMMARY OF THE INVENTION

It is a general object of at least one embodiment of the present invention to provide an image forming apparatus that substantially eliminates one or more problems caused by the limitations and disadvantages of the related art.

In one embodiment, an image forming apparatus includes a recording head having nozzles to form an image by squirting droplets onto a recording medium, a transfer member transferring the recording medium and having holes which allows passage of droplets squirted by the recording head for non-printing discharge, an area detecting unit to detect a plurality of non-printing discharge areas that are areas between adjacent recording media, and a non-printing discharge instructing unit to cause the nozzles to perform non-printing discharge such that all the nozzles perform non-printing discharge at least once in the non-printing discharge areas.

According to at least one embodiment, the image forming apparatus can perform efficient non-printing discharge even if the intervals of recording media (e.g., print sheets) are shortened.

BRIEF DESCRIPTION OF THE DRAWINGS

Other objects and further features of embodiments will be apparent from the following detailed description when read in conjunction with the accompanying drawings, in which:

FIG. 11 is a drawing for illustrating non-printing discharge data;

FIG. 17 is a drawing illustrating non-printing discharge according to an implementation of the embodiment;

FIG. 18 is a drawing illustrating non-printing discharge according to another implementation of the embodiment;

FIG. 19 is a drawing illustrating non-printing discharge according to yet another implementation of the embodiment;

DESCRIPTION OF THE PREFERRED EMBODIMENTS

Description of Terms

A description of terms will be provided before providing a description of embodiments. An image forming apparatus may be a printer, a facsimile apparatus, a copier apparatus, a plotter, any combination of these, or the like. A recording medium may be paper, thread, fiber, leather, metal, plastic, glass, wood, ceramics, or the like, for example. Image formation may refer to attaching an image such as a letter, a figure, or a pattern to a recording medium, and may also refer to spurting droplets (i.e., ink droplets) to a recording medium. In the following, a description will be given with respect to an example in which a paper sheet serves as a recording medium, and printing serves as image formation. Elements having the same function in block diagrams or processes performing the same processing are referred to by the same reference numbers, and a duplicate description thereof will be omitted.

[Overall Description of Image Forming Apparatus]

Figure 1:
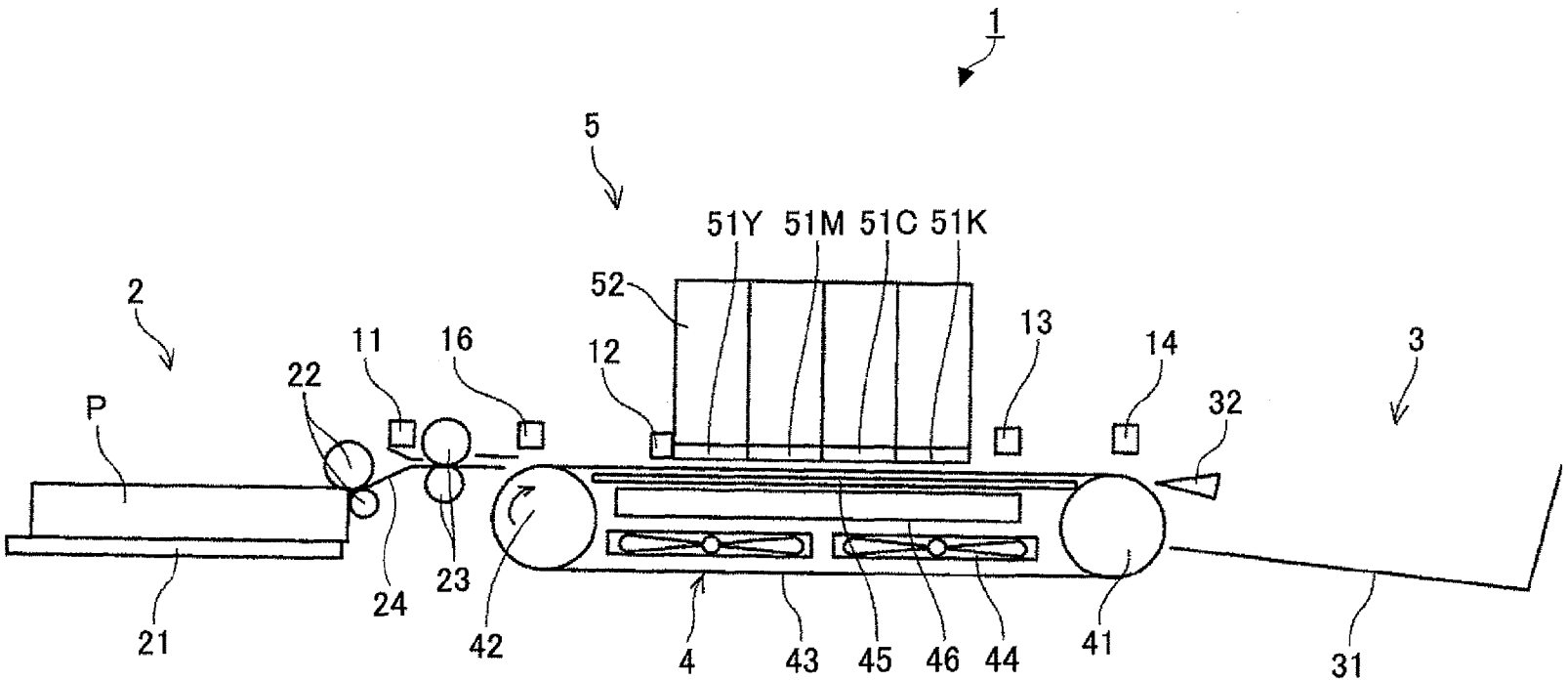
FIG. 1 is a drawing showing a schematic configuration of an image forming apparatus.
Figure 2:
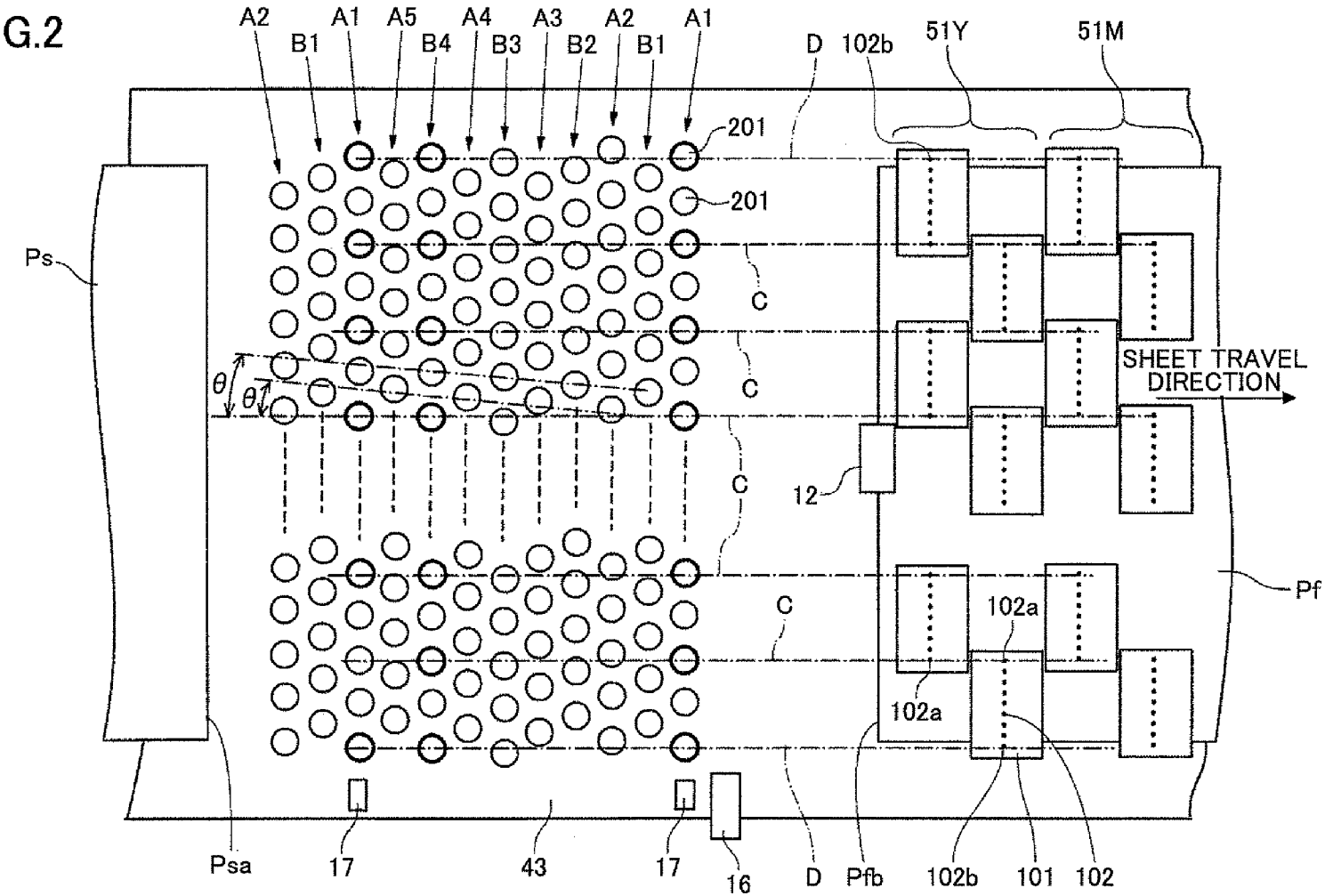
FIG. 2 is an illustrative plan view of part of the image forming apparatus.

FIG. 1 is a schematic view of a main section of an image forming apparatus according to a present embodiment. FIG. 2 is a plan view illustrating the main section of the image forming apparatus. In FIG. 2, the nozzles of recording heads are illustrated as a transparent view.

An image forming apparatus 1 is a line-type image forming apparatus. The image forming apparatus 1 includes a paper feed unit 2 for feeding paper from a stack of print sheets P, a paper receiving unit 3 for receiving printed print sheets P, a transfer unit for transferring the print sheets P from the paper feed unit 2 to the paper receiving unit 3, and an image forming unit 5 for squirting droplets onto the print sheets P transferred by the transfer unit 4 to form images thereon.

The paper feed unit 2 includes a paper feed tray 21 on which the print sheets P are placed, a pair of sheet feeding rollers 22 for catching and feeding a sheet from the print sheets P, a pair of resist rollers 23, and a guide member 24 for guiding the print sheets P along the travel path.

The paper receiving unit 3 includes a paper receiving tray 31 on which the print sheets P are placed as they are discharged from a jump platform 32, which smoothly ejects a print sheet by guiding the bottom surface of the print sheet that is supplied from a transfer belt 43.

The transfer unit 4 includes the endless transfer belt 43 stretched between a drive roller (transfer roller) 41 and a driven roller 42, and also includes a suction unit 44 such as a suction fan that sucks air through suction holes 201 (hereinafter referred to as "holes") 201 of the transfer belt 43 to cause a print sheet to adhere to the transfer belt 43. The transfer unit 4 further includes a platen member (distortion preventing member) 45 for supporting the transfer belt 43 from the back surface thereof at the position where the image forming unit is situated, and includes a waste ink receiving tray 46 for receiving droplets (waste liquid) squirted by non-printing discharge. A print sheet is attached through air suction to the transfer belt 43, which rotates in the direction indicated by an arrow shown in FIG. 1, so that the transfer unit 4 carries the print sheet from the left-hand side of the figure to the right-hand side of the figure. Here, the term "non-printing discharge" refers to an action of squirting ink from nozzles on a mandatory basis toward areas outside a print sheet. In other words, non-printing discharge refers to an action of squirting ink that does not contribute to image formation. The transfer belt 43 is an endless belt to carry print sheets, and has a plurality of holes which allows the passage of droplets that are squirted from the recording heads by non-printing discharge.

The image forming unit 5 includes a head module array 50 inclusive of line-type recording heads 51Y, 51M, 51C, and 51K for four colors, which squirt inks of four colors (i.e., yellow Y, magenta M, cyan C, and black K) toward a print sheet P attached to and transferred by the transfer belt 43. These recording heads will be simply referred to as recording heads 51 when there is no need to discriminate colors. The image forming unit 5 further includes a supply member 52 for supplying inks from ink tanks such as sub-tanks to the recording heads 51.

Figure 3:
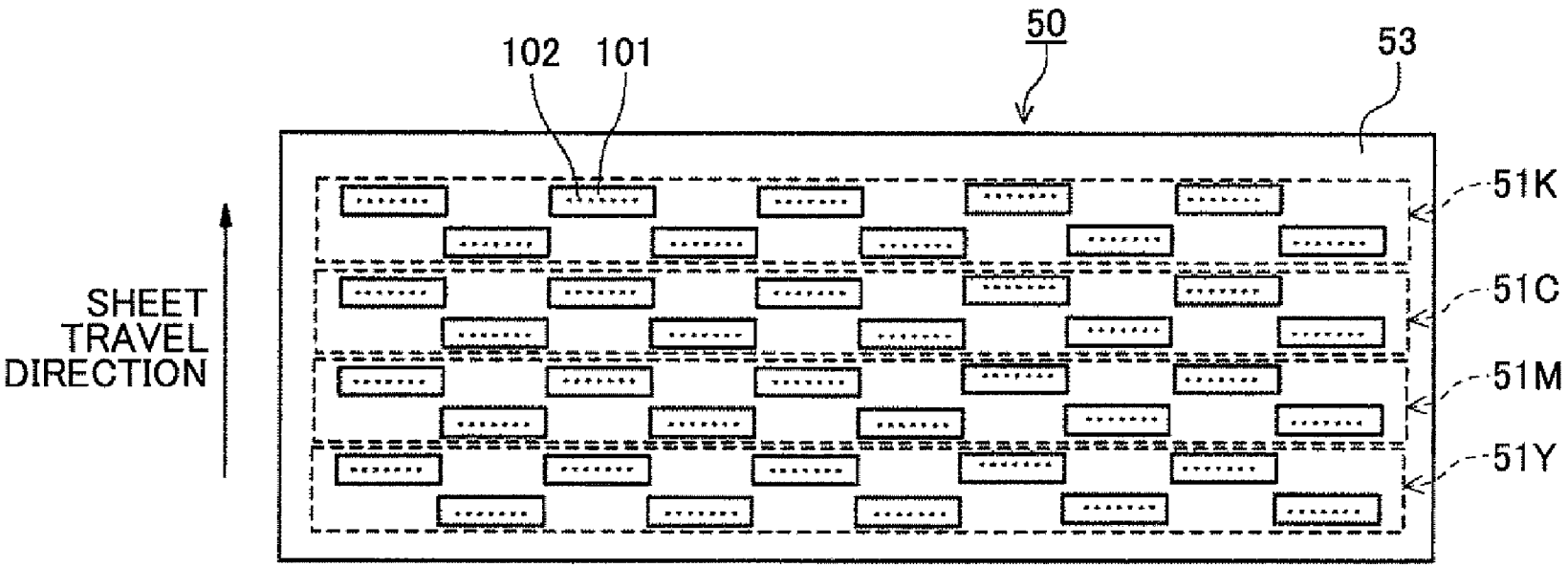
FIG. 3 is a drawing illustrating an example of a head module.

FIG. 3 is a drawing illustrating the head module array 50 of the image forming unit 5. As illustrated in FIG. 3, the head module array 50 of the image forming unit 5 includes a plurality of heads 101 arranged on a base member 53 in a staggered manner in a direction crossing (e.g. perpendicular to) the sheet travel direction. Each of the heads 101 has a nozzle line, which is comprised of nozzles 102 arranged in line. Each of the recording heads 51 for respective colors is comprised of a plurality (i.e., 10 in this example) of the heads 101 arranged in a staggered manner in two lines. The direction in which the heads 101 (nozzle lines) are oriented is referred to as a head arrangement direction. The entirety of nozzles arranged in the direction crossing the sheet travel direction as provided by the plurality of heads 101 is referred to as the nozzle lines of the recording heads.

Figure 4:
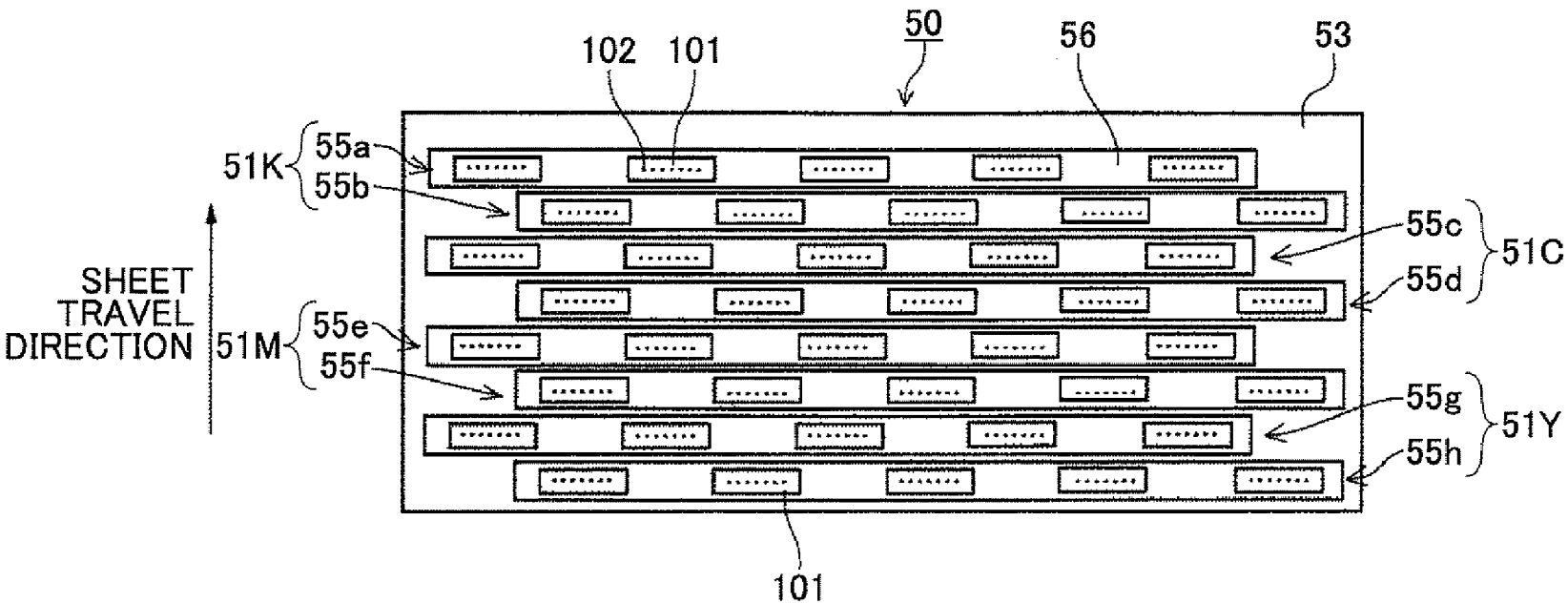
FIG. 4 is a drawing illustrating another example of a head module.

The configuration of the head module array is not limited to the configuration described above. For example, eight head modules 55*a* through 55*h* may be arranged on the base member 53 in the sheet travel direction as illustrated in FIG. 4. Each of the head modules 55*a* through 55*h* is comprised of a plurality (i.e., 5 in this example) of the heads 101 arranged on a base member 56. The heads 101 are arranged in a staggered manner for two head modules that are adjacent to each other in the sheet travel direction.

Figure 5:
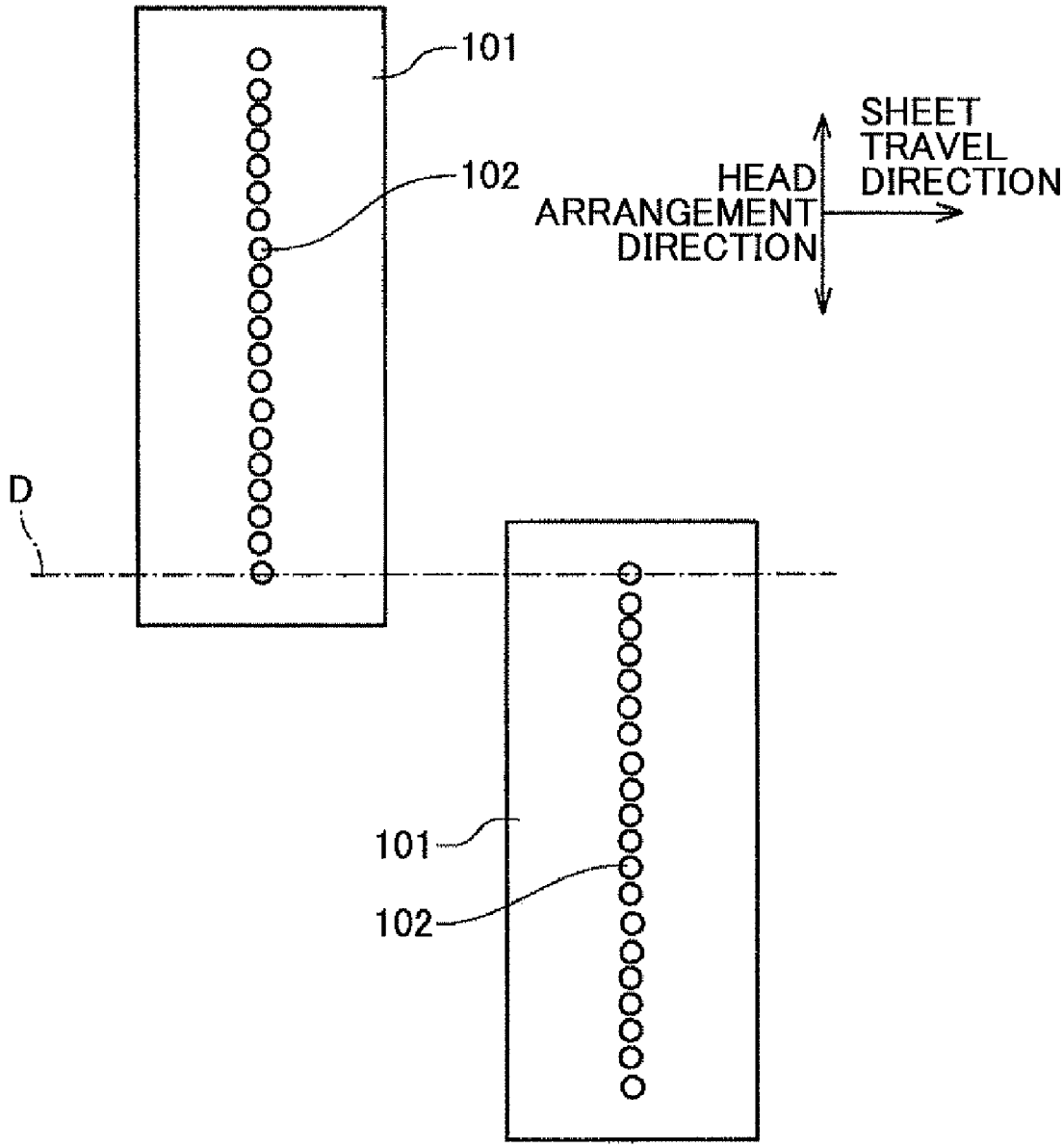
FIG. 5 is a drawing for illustrating an head overlapping portion.

As illustrated in FIG. 5, the heads 101 are arranged such that one or more nozzles 102 at an end overlap between the two heads 101 that are adjacent to each other in the head arrangement direction. This arrangement allows the overlapping nozzles 102 of these two heads 101 to perform recording at the same recording position (i.e., the same dot position).

In the following, a further description will be given with respect to FIGS. 1 and 2. A first print sheet detecting unit 11 is provided upstream in the sheet travel direction relative to the resist rollers 23 for the purpose of controlling the drive timing of the sheet feeding rollers 22 for catching and feeding a print sheet and for the purpose of detecting the position and size of the paper sheet. A recording position detecting unit 12 is provided upstream relative to the image forming unit 5 to determine the timing of droplets discharge from the recording heads 51 and to detect the rear end of a print sheet. A second print sheet detecting unit 13 is provided downstream relative to the image forming unit 5 to detect the position of a print sheet. A print-sheet-rear-end detecting unit 14 is situated directly above the drive roller 41 for the purpose of detecting the jamming of a print sheet and for the purpose of determining the timing of supply of a next print sheet.

As illustrated in FIG. 2, hole marks 17 are provided on the transfer belt 43. Further, a mark detecting unit 16 is provided as illustrated in FIG. 2 to detect the hole marks 17 for the purpose of detecting the positions of holes.

In the following, a description will be given of the configuration of the image forming apparatus relating to non-printing discharge.

Referring to FIG. 2, the transfer belt 43 has a plurality of suction holes 201, which are arranged to pass the positions of the nozzles 102 with respect to all the nozzles 102 of the recording heads 51. An array of the suction holes 201 arranged in the head arrangement direction is referred to as a suction hole line. In this example, suction hole lines A1 through A5 (which may be referred to as suction hole lines A when there is no need for discrimination) and suction hole lines B1 through B4 (which may be referred to as suction hole lines B when there is no need for discrimination) are arranged at constant intervals from the right-hand side to the left-hand side in FIG. 2, i.e., from downstream to upstream in the sheet travel direction. Both the suction hole lines A and the suction hole lines B are arranged such that the centers of the suction holes 201 are aligned on an imaginary line extending at an angle θ relative to the sheet travel direction, and such that the suction holes 201 are arranged at constant intervals in a direction perpendicular to the sheet travel direction. With this arrangement, a total of nine lines, i.e., the suction hole lines A1 through A5 and B1 through B4, can provide suction holes that pass through the positions of all the nozzles 102 of all the recording heads 51.

The size (i.e., diameter) of a hole is the same for all the suction holes 201. As a result, a constant number of consecutive nozzles squirt ink toward any single one of the suction holes 201. As far as one or more nozzles 102*a* and one or more nozzles 102*b* are concerned, the number of nozzles for squirting ink toward a single suction hole 201 is approximately half the above-noted constant number. The one or more nozzles 102*a* are situated in an overlapping area (i.e., an overlap in the nozzle arrangement direction) between two adjacent heads 101 of the recording heads 51 that are arranged in a staggered manner. The one or more nozzles 102*b* are situated at an end of the nozzle line of the recording heads 51, and are not frequently used. The number of one or more nozzles 102*a* or 102*b* is not limited to one. Namely, two or more nozzles 102*a* may be provided as overlapping nozzles 102 in the nozzle arrangement direction. The number of one or more nozzles 102*b* at an end of the nozzle line is also not limited to one. Two or more nozzles 102 may be treated as nozzles 102*b* when taking into account non-printing discharge.

In other words, the number of nozzles for squirting ink toward a suction hole 201 in the overlapping area of the heads 101 is equal to the sum of about half the constant number of nozzles of a head 101 situated upstream in the sheet travel direction that perform non-printing discharge toward this suction hole 201 and about half the constant number of nozzles of another head 101 situated downstream in the sheet travel direction that perform non-printing discharge toward this suction hole 201. Accordingly, the sum of about half the constant number and about half the constant number equals to about the constant number, which is the number of nozzles performing non-printing discharge in the non-overlapping areas.

Further, the arrangement pattern of the suction hole lines A and B is repeated, so that another set of suction hole lines is provided next to the suction hole line A5 in the order as follows: A1, B1, A2, B2, and so on.

Moreover, the suction hole line A1 includes one suction hole 201 having the center thereof situated on a line C and another suction hole 201 having the center thereof situated on a line D. The lines C and D are parallel to the sheet travel direction, and pass through the positions of the nozzles 102*a* and 102*b*, respectively. The nozzles 102*a* are situated in an overlapping area between two adjacent heads 101 that are arranged in a staggered manner. The nozzles 102*b* are situated at the ends of the recording heads 51 in the head arrangement direction, and are not frequently used. In FIG. 2, the relevant suction holes 201 are illustrated by thick lines.

The suction hole line A1, which has the suction holes 201 passing through the positions of the nozzles 102*a* and 102*b* situated at the overlapping point between two adjacent heads 101 arranged in the head arrangement direction and at the ends of the recording heads 51, respectively, is defined as a reference suction hole line (i.e., reference hole line). The hole marks 17 are formed at the side ends of the transfer belt 43 (i.e., ends in the head arrangement direction) for the purpose of detecting the position of the reference hole line A1. The mark detecting unit 16 is used to detect the hole marks 17. The hole marks 17 are formed at intervals in the same manner in which the suction hole lines (reference hole lines) A1 are formed at intervals across the entire length of the transfer belt 43.

In the present embodiment, the suction hole line B4 has the same arrangement of suction holes 201 as the arrangement of suction holes 201 of the suction hole line A1. Relevant holes of B4 are illustrated by thick lines. The suction holes 201 are provided in the transfer belt 43 for the purpose of sucking a print sheet P, and are evenly arranged. Accordingly, the suction hole line B4 that comes into being as a result of the arrangement pattern may not be used as suction holes for performing non-printing discharge, and may only be used as suction holes for sucking a print sheet. Alternatively, a second-time non-printing discharge may be performed with respect to the suction holes 201 of the suction hole line B4 corresponding to the nozzles 102*a* situated at the head overlapping position and the infrequently-used nozzles 102*b* situated at the ends in the head arrangement direction. This may serve to maintain the nozzles 102 at these positions in a better discharge condition.

Figure 6:
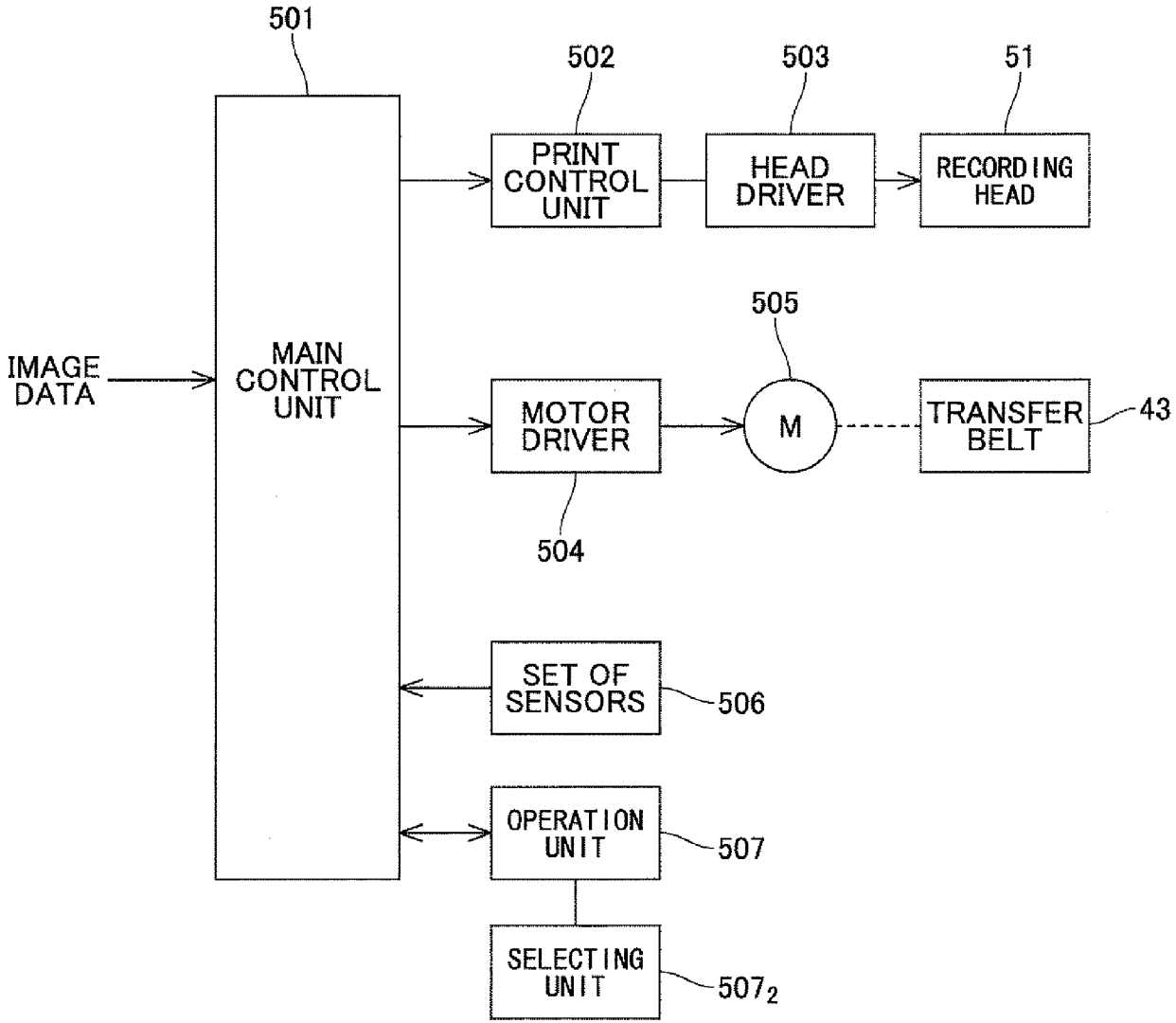
FIG. 6 is a block diagram illustrating the outline of a control unit.

In the following, the outline of a control unit of the image forming apparatus will be described by referring to a block diagram illustrated in FIG. 6.

The control unit includes a main control unit (system controller) 501, which includes a communication interface, an image memory, and a microcomputer that serves as a control means to perform the overall control of the image forming apparatus and to control a procedure relating to non-printing discharge. The main control unit 501 sends print data to a print control unit 502 to form an image on a print sheet in response to image data and command information supplied from an external information processing apparatus (i.e., host device).

The print control unit 502 generates data for driving a pressure generating unit to cause the nozzles 102 of the recording heads 51 to discharge droplets based on the print data signals received from the main control unit 501. The print control unit 502 sends various signals required for the transfer of the data and the completion of the transfer to a head driver 503. The print control unit 502 includes a memory unit serving as a drive waveform data storage unit, a D/A converting unit for performing D/A conversion of drive waveform data, a drive waveform generating unit inclusive of a voltage amplifier and a current amplifier, and a selecting unit for selecting a drive waveform supplied to the head driver 503. The print control unit 502 generates a drive waveform comprised of a single drive pulse (i.e., drive signal) or a plurality of drive pulses (i.e., drive signals) for provision to the head driver 503, thereby driving and controlling the recording heads 51.

The main control unit 501 uses a motor driver 504 to drive and control a sheet shift motor 505 for rotating the transfer belt 43 and a motor for driving the suction fan 44. The main control unit 501 further drives and controls a paper feed motor for feeding a print sheet P from the paper feed unit 2, the illustration of which is omitted in FIG. 6.

The main control unit 501 receives detection signals from a sensor set 506, which includes the previously described various detection units, the detection sensors 11 through 16, and various types of other sensors. The main control unit 501 also performs inputting and outputting of various types of information and exchanges display information with an operation unit 507.

In the following, an image forming operation performed by the image forming apparatus will be described. Image data to be printed is supplied from an information processing apparatus to the communication interface of the main control unit 501 for storage in the image memory thereof. The main control unit 501 uses a sheet shift drive unit to drive the sheet feeding rollers 22, thereby fetching a print sheet P at the top of the stack on the paper feed tray 21 for provision to the resist rollers 23. The main control unit 501 also starts the rotation of the transfer belt 43 at predetermined timing. Upon receiving a sheet detection signal from the print sheet detecting unit 11, the main control unit 501 drives the resist rollers 23, after some delay, to send the print sheet P to the transfer belt 43. In response to the detection that the front end, of the print sheet P has reached the sensor unit of the recording position detecting unit 12, the main control unit 501 causes the recording heads 51 to squirt droplets in response to image data to the print sheet P traveling according to predetermined timing. Namely, the image data stored in the image memory is transferred to the print control unit 502 for conversion into dot data for respective colors. In response to the dot data, the print control unit 502 uses the head driver 503 to drive the recording heads 51, thereby making the nozzles 102 squirt droplets.

The droplet discharge timing of the recording heads 51 is controlled in synchronization with the travel speed of the print sheet P based on the detection results supplied from the recording position detecting unit 12. With this arrangement, an image is formed on the print sheet P without stopping the movement of the print sheet P.

The print sheet P on which an image has been formed is further transferred by the transfer belt 43 to be discharged onto the paper receiving tray 31 of the paper receiving unit 3.

In the following, a non-printing discharge operation performed by the image forming apparatus will be described. During a print operation or in a standby state, some nozzles 102 may not be frequently used, and may not discharge ink droplets for some time period. In such a case, ink solvent in or around the nozzles may evaporate, resulting in ink viscosity being increased. When this happens, the nozzles 102 fail to discharge ink droplets upon the activation of an actuator of the heads 101. To avoid such a condition, non-printing discharge is performed to discharge degraded ink (i.e., ink with increased viscosity in or around the nozzles) by activating the actuator while the viscosity of the ink is as low as to be dischargeable by driving the heads 101. It may be noted that non-printing discharge is performed only after a predetermined time lapse or a predetermined number of recording opportunities passes with respect to non-operating nozzles.

Recording may be constantly performed until the passage of the predetermined time lapse or the occurrence of the predetermined number of recordings is detected. In such a case, the main control unit 501 (see FIG. 6) detects the front end of a next print sheet P by use of the first print sheet detecting unit 11. After the rear end of a current print sheet P passes the detection position of the recording position detecting unit 12, the main control unit 501 uses the print control unit 502 to send drive data according to a non-printing discharge pattern to the head driver 503. With this arrangement, the main control unit 501 causes the nozzles 102 of the recording head 51Y to squirt droplets (i.e., non-printing discharge droplets) that do not contribute to recording. It may be noted that the non-printing discharge operation is performed in response to instruction from a non-printing discharge instructing unit 5012 (see FIG. 13). Ink discharge for forming an image is performed by a discharge instructing unit.

With the arrangement described above, a sheet interval between the rear end of a current print sheet P and the front end of a next print sheet P is utilized. Namely, upon the space (i.e., gap) between two adjacent print sheets P being situated at the position of the recording heads 51, the nozzles of the recording head 51Y are made to squirt non-printing discharge droplets toward the suction holes 201 that are arranged to pass the positions of the nozzles 102 of the recording heads 51 in the transfer belt 43 between the print sheets.

The non-printing discharge droplets squirted toward the suction holes 201 of the transfer belt 43 pass through the suction holes 201 of the transfer belt 43 and the through holes formed through the distortion preventing member 45 to reach the waste ink receiving tray 46 provided below. This removes dried ink and viscosity-changed degraded ink, caused by infrequent use, from the nozzles 102 of the recording heads 51.

After the non-printing discharge from the nozzles 102 of the recording head 51Y, the suction holes 201 of the transfer belt 43 move across the positions of the nozzles 102 of the recording heads 51M, 51C, and 51K successively. In conjunction with this movement, the recording heads 51Y, 51C, and 51K perform non-printing discharge.

The main control unit 501 controls the droplets discharge timing such that the recording heads 51M, 51C, and 51K squirt non-printing discharge droplets toward substantially the same position as the suction holes 201 of the transfer belt 43 to which the non-printing discharge by the recording head 51Y is performed. Namely, the recording heads 51M, 51C, and 51K perform non-printing discharge with respect to the suction holes 201 of the transfer belt substantially at the same position that the recording head 51Y has performed non-printing discharge, based on the detection result of the recording position detecting unit 12. The manner in which the activation timing of each recording head 51 is shifted for non-printing discharge is the same as the manner in which the activation timing of each recording head 51 is shifted for regular printing operations. It may be noted that non-printing discharge is performed by using a detection signal indicative of the rear end of a print sheet P while regular printing discharge is performed by using a detection signal indicative of the front end of a print sheet detected by the recording position detecting unit 12.

Figure 7:
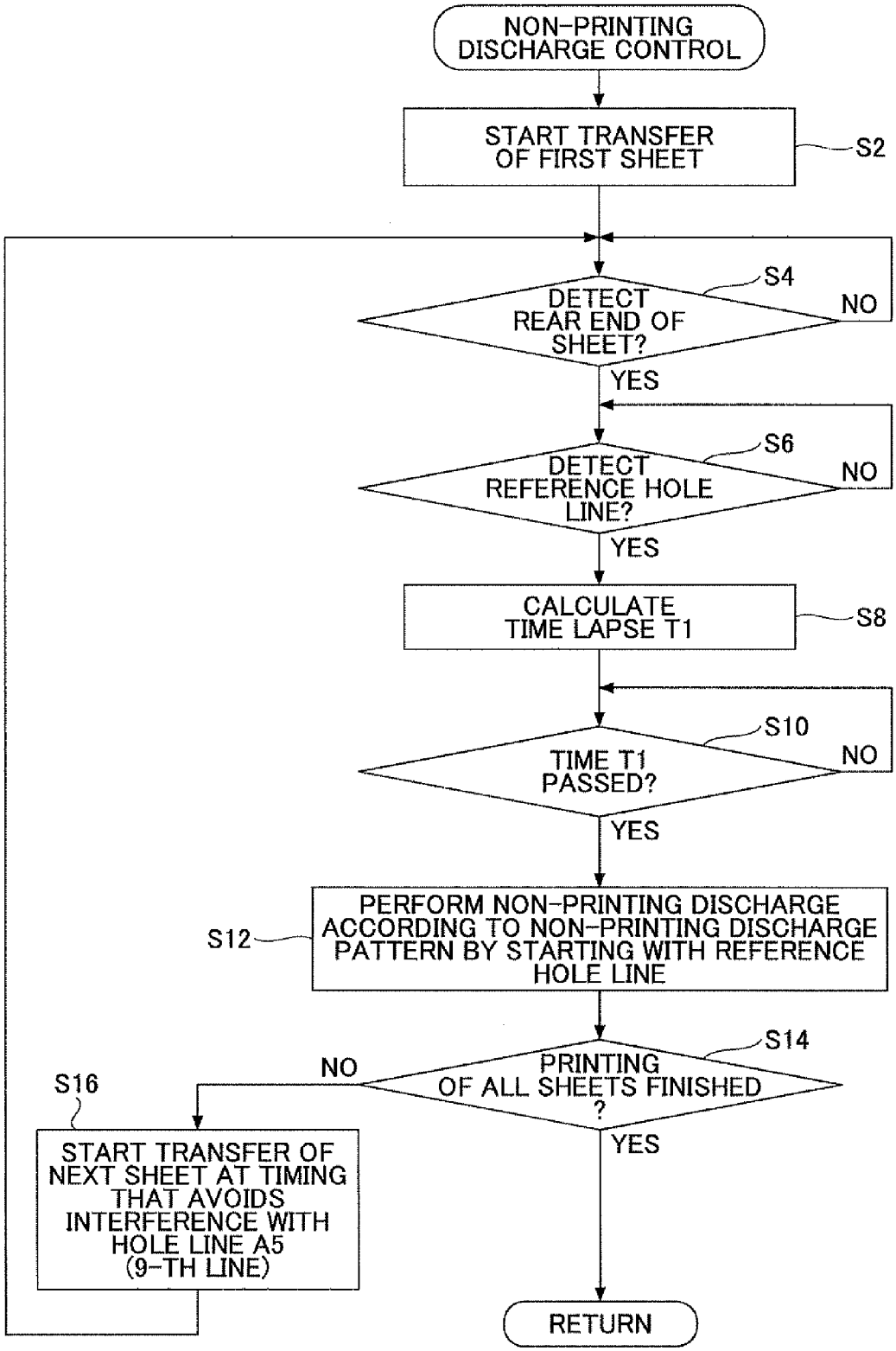
FIG. 7 is a flowchart illustrating the control of non-printing discharge operations.

In the following, the control of non-printing discharge by the main control unit will be described by referring to a flowchart illustrated in FIG. 7.

As was previously described, the suction hole line A1 includes one suction hole 201 having the center thereof situated on a line C and another suction hole 201 having the center thereof situated on a line D (see FIG. 2). The lines C and D are parallel to the sheet travel direction, and pass through the positions of the nozzles 102*a* and 102*b*, respectively. The nozzles 102*a* are situated in an overlapping area between two adjacent heads 101 that are arranged in a staggered manner. The nozzles 102*b* are infrequently used nozzles situated at the ends in the head arrangement direction.

The main control unit 501 starts the transfer of a first (preceding) print sheet Pf (see FIG. 2) (step S2). The main control unit 501 checks whether the recording position detecting unit 12 detects the rear end Pfb of the first print sheet Pf (step S4). Upon the rear end Pfb of the first print sheet Pf being detected by the recording position detecting unit 12 (Yes in step S4), the main control unit 501 checks whether the mark detecting unit 16 detects a hole mark 17 on the transfer belt 43 (step S6).

Upon the hole mark 17 of the transfer belt 43 being detected by the mark detecting unit 16, the main control unit 501 calculates or obtains a time lapse T that is taken for the reference hole line A1 to reach the position of the first recording head 51Y (step S8). The main control unit 501 checks (step S10) whether the time lapse T1 has passed since the mark detecting unit 16 detected the hole mark 17.

Upon the passage of the time lapse T1, the reference hole line A1 reaches the position of the first recording head 51Y (Yes in step S10). Namely, the time lapse T1 has passed since the detection of the reference hole line A1. In response, the recording head 51Y is caused to perform non-printing discharge according to the non-printing discharge pattern toward the suction holes 201 by starting with the reference hole line A1 (step S12).

As was previously described, the suction hole line A1 includes one suction hole 201 having the center thereof situated on a line C and another suction hole 201 having the center thereof situated on a line D (see FIG. 2). The lines C and D are parallel to the sheet travel direction, and pass through the positions of the nozzles 102*a* and 102*b*, respectively. The nozzles 102*a* are situated in an overlapping area between two adjacent heads 101 that are arranged in a staggered manner. The nozzles 102*b* are infrequently used nozzles situated at the ends in the head arrangement direction. Accordingly, it is ensured that the nozzles 102*a* and 102*b* situated in these areas be able to perform non-printing discharge. If the reference hole line A1 includes suction holes 201 corresponding to other areas, the nozzles 102 situated at the positions of these suction holes 201 can also perform non-printing discharge.

The main control unit 501 stores therein non-printing discharge patterns corresponding to a total of 9 suction hole lines from the suction hole line (reference hole line) A1 to the suction hole line A5, i.e., the suction hole lines A1 through A5 and B1 through B4. Non-printing discharge is performed according to these patterns. As was previously described, however, the non-printing discharge patterns may be configured such that a second-time non-printing discharge may be performed with respect to the suction holes 201 of the suction hole line B4 corresponding to the nozzles 102*a* situated at the head overlapping position and the infrequently-used nozzles 102*b* situated at the ends in the head arrangement direction, thereby maintaining the nozzles 102*a* and 102*b* in a better discharge condition.

After the reference hole line A1 passes the position of the recording head 51Y, the suction holes 201 of the suction hole lines B1, A2, B2, and so on formed in the transfer belt 43 pass the position of the recording head 51Y one after another. The main control unit 501 calculates the time lapse that is taken for each suction hole line to reach the position of the recording head 51Y by using as a reference the timing at which the reference hole line A1 reaches the position of the recording head 51Y. Based on the calculated timing, the main control unit 501 causes the nozzles 102 of the recording head 51Y to perform non-printing discharge toward the suction holes 201 of the suction hole line B1 and the subsequent suction hole lines according to the non-printing discharge patterns noted above.

Non-printing discharge is performed similarly with respect to other recording heads 51M, 51C, and 51K, so that non-printing discharge for all the nozzles 102 is completed.

After this, if printing of all the print sheets is not yet completed (No in step S14), the main control unit 501 starts the transfer of a next print sheet Ps (step S16) at such timing as the front end Psa of the next print sheet Ps does not interfere with the suction hole line A5 (i.e., ninth line), which is the last line of the suction hole lines being subjected to non-printing discharge.

With reference to FIGS. 8A through 8D, a description will be given of the manner in which non-printing discharge is performed toward suction holes when two types of suction holes (i.e., suction holes corresponding to the nozzles 102*a* situated in an overlapping area between adjacent heads 101 arranged in a staggered manner and the infrequently used nozzles 102*b* situated at the ends in the head arrangement direction) formed in the transfer belt 43 move in the sheet travel direction. In FIGS. 8A through 8D, the nozzles that are performing non-printing discharge are illustrated as solid circles. In general, plural droplets are ejected through non-printing discharge. In FIGS. 8A through 8D, such multiple droplet ejections are not illustrated.

Figure 8A:
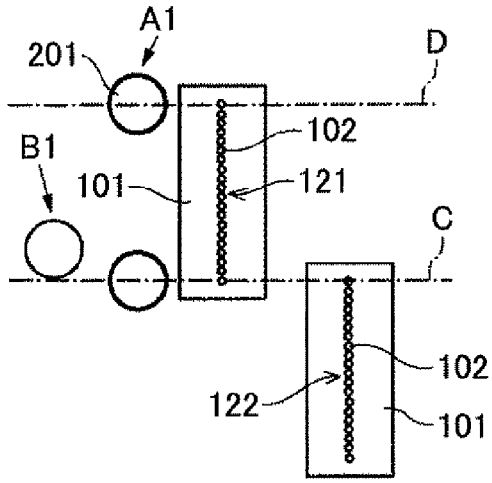
FIGS. 8A through 8D are drawings for illustrating non-printing discharge operations.
Figure 8B:
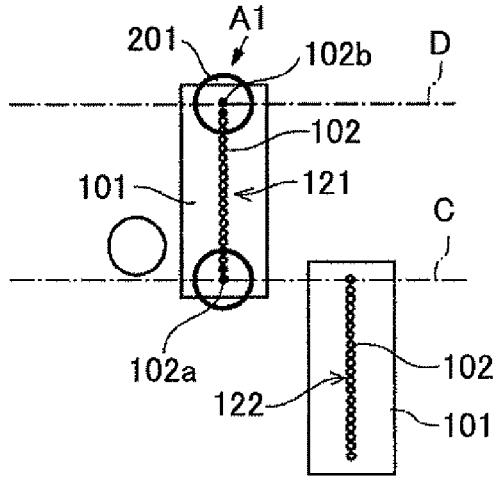

As illustrated in FIG. 8A, the transfer belt 43 is initially at such a position that the reference hole line A1 of the transfer belt 43 is about to reach the position of a nozzle line 121 that performs non-printing discharge first. As illustrated in FIG. 8B, the reference hole line A1 reaches the nozzle line 121, so that the two nozzles 102*a* at the head overlapping position and the two nozzles 102*b* at the ends in the head arrangement direction perform non-printing discharge.

Figure 8C:
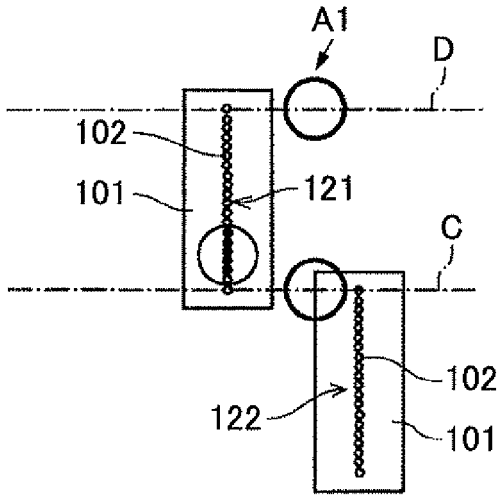
Figure 8D:
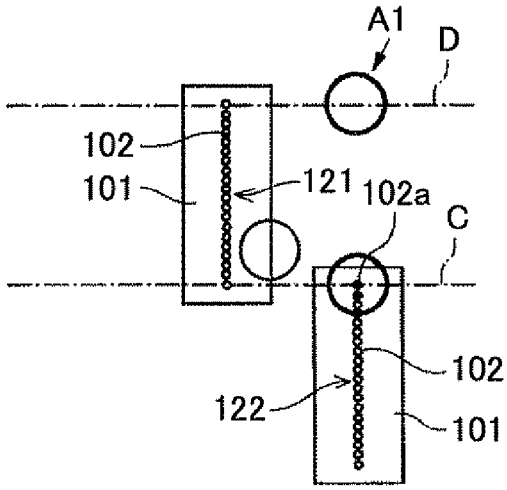

As illustrated in FIG. 8C, then, the suction hole line B1 next following the reference hole line A1 reaches the nozzle line 121, so that four nozzles 102 perform non-printing discharge. As illustrated in FIG. 8D, further, two nozzles 102*a* that are included in a nozzle line 122 of the next head 101 arranged in a staggered manner and that are situated at the overlapping point perform non-printing discharge toward the reference hole line A1.

In this manner, at least one of the suction hole lines situated in the transfer belt is a reference hole line that includes suction holes passing the positions of nozzles situated at the ends of a nozzle line of the recording heads and nozzles situated at the overlapping points between two adjacent heads arranged in the nozzle arrangement direction. The nozzles of the recording heads perform non-printing discharge toward suction holes by using the reference hole line as a reference point. With this arrangement, non-printing discharge is easily performed at the same timing with respect to the nozzles situated at the ends of a nozzle line of the recording heads and the nozzles situated at the head overlapping position.

Namely, some suction holes in the transfer belt are arranged to match the positions of the nozzles situated at the overlapping portion of the heads arranged in a staggered manner and the infrequently used nozzles situate at the ends of the recording heads. With this arrangement, non-printing discharge is performed with respect to these nozzles with definite certainty.

In this case, one suction hole line extending in the same direction as the head arrangement direction includes the suction holes that match the positions of all the nozzles situated at the overlapping portion of the heads arranged in a staggered manner and the positions of all the infrequently used nozzles situate at the ends of the recording heads. With this provision, a single suction hole line passing under a first set of heads arranged in a staggered manner ensures that non-printing discharge be completed at once in a short time.

The recording heads for squirting different-color droplets situated downstream in the sheet travel direction may be arranged in the same manner as the recording heads of the first set are arranged. This ensures that all the nozzles situated at the overlapping positions and all the infrequently used nozzles situated at the recording head ends be able to perform non-printing discharge as the transfer belt moves.

Further, plural suction hole lines inclusive of a reference hole line may be provided at predetermined intervals in the transfer belt. Further, sheet travel timing may be controlled such that suction hole lines situated downstream relative to a predetermined suction hole line are used among the suction hole lines including two or more reference hole lines provided at predetermined intervals. With this provision, non-printing discharge can be performed immediately after the rear end of a print sheet passes. This makes it possible to prepare for a next print sheet. Further, even when the predetermined suction hole line is covered with a print sheet, a suction hole line suitable for non-printing discharge appears in the next cycle without failure. This can reduce the wait time for non-printing discharge.

Moreover, marks are provided on the transfer belt for detecting reference hole lines. These marks are detected to locate the reference hole lines. This provision makes it possible to ascertain whether a suction hole line suitable for non-printing discharge is present immediately upstream from a print sheet. Diligent control of non-printing discharge timing can thus be achieved. Moreover, the detection of a reference hole line makes it possible to control the transfer of a next print sheet to avoid interference with a suction hole line being subjected to non-printing discharge.

Figure 9:
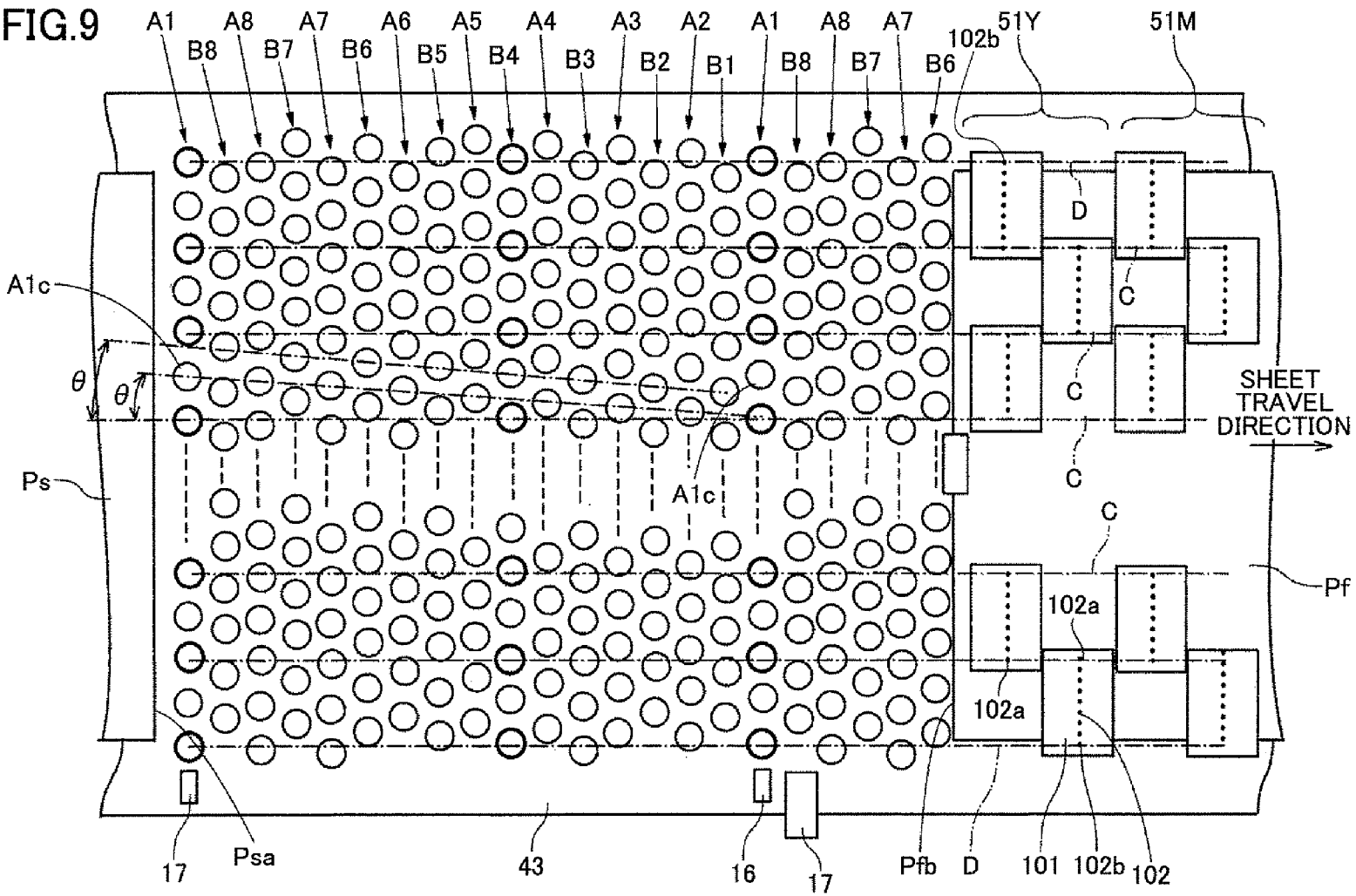
FIG. 9 is an illustrative plan view of part of the image forming apparatus according to another embodiment.

In the following, another embodiment will be described by referring to FIG. 9. FIG. 9 is a plan view of the present embodiment similar to the view illustrated in FIG. 2.

Like what is illustrated in FIG. 2, the suction hole line A1 of the present embodiment includes a suction hole 201 having the center thereof passing the position of a corresponding one of the nozzles 102*a* and 102*b*. The nozzles 102*a* are situated in an overlapping area between two adjacent heads 101 that are arranged in a staggered manner. The nozzles 102*b* are infrequently used nozzles situated at the ends in the head arrangement direction. Similarly to the manner described with reference to the previous embodiment, the reference hole line A1 may include other suction holes 201.

In the previous embodiment illustrated in FIG. 2, the suction hole line A5 and the suction hole line A1 situated upstream thereto in the sheet travel direction are discontinuous with each other when considered as an array of suction hole lines. In the present embodiment, on the other hand, both the suction hole lines A and the suction hole lines B are arranged such that the centers of the suction holes 201 are aligned on an imaginary line extending at an angle θ relative to the sheet travel direction as illustrated in FIG. 9. Also, the imaginary line crosses the next-cycle suction hole line A1 at the center A1*c* of the suction hole 201 that is situated in the middle point between the two suction holes 201 corresponding to the nozzles 102*a* situated at the overlapping positions of the heads 101 arranged in a staggered manner. This point differs from the previous embodiment.

In the previous embodiment illustrated in FIG. 2, a total of nine lines from the reference hole line A1 to the suction hole line A5 can provide suction holes that pass the positions of all the nozzles 102 of all the recording heads 51, thereby completing non-printing discharge. In the present embodiment illustrated in FIG. 9, a total of 16 lines, i.e., the suction hole lines A1 through A8 and B1 through B8, are provided. A total of nine lines starting from any one of these 16 lines can provide suction holes that pass the positions of all the nozzles 102 of all the recording heads 51, thereby completing non-printing discharge.

Non-printing discharge can be performed immediately after the rear end Pfb of the preceding print sheet Pf. This allows the distance to the front end Psa of the next print sheet Ps to be set to a minimum, thereby improving printout productivity.

Moreover, the interval between the suction hole lines may be narrowed to further shorten the above-noted distance. In the present embodiment, one suction hole 201 is provided between two suction holes 201 corresponding to the overlapping positions of the heads 101. Alternatively, plural suction holes may be provided to reduce the number of suction hole lines that are needed to allow all the nozzles to perform non-printing discharge, i.e., to make the number smaller than nine of the above-noted example.

Figure 10:
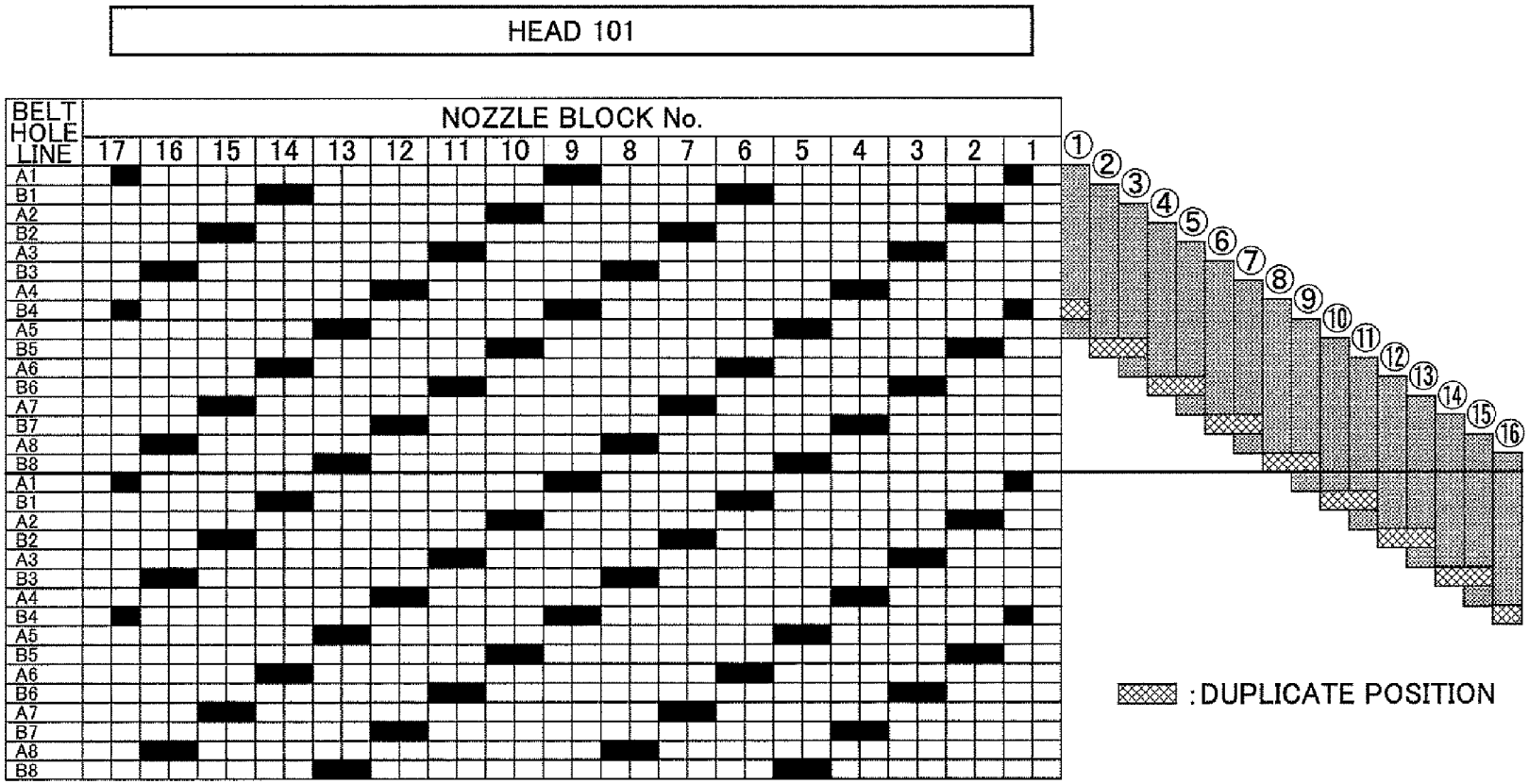
FIG. 10 is a drawing illustrating an example of non-printing discharge patterns.

FIG. 10 illustrates non-printing discharge patterns 1 through 16 (shown as encircled numbers in FIG. 10) corresponding to the suction hole lines A1 through A8 and B1 through B8. The main control unit 501 stores therein non-printing discharge patterns 1 through 16, each of which corresponds to a total of 9 suction hole lines starting from a given suction hole line. Non-printing discharge is performed as illustrated in FIG. 10. In FIG. 10, the nozzles 102 of each head 101 are divided into 17 blocks (i.e., nozzle blocks No. 1 through No. 17). In these 17 blocks, nozzles that perform non-printing discharge toward the suction holes 201 of the suction hole lines A1 through B8 are illustrated as black dots. It may be noted that the "duplicate position" refers to a hole line on which non-printing discharge does not need to be performed.

In the control of non-printing discharge, a signal indicative of the detection of a hole mark 17 is used as a reference point when the hole mark 17 is detected by the mark detecting unit 16 immediately before the rear end Efb of the preceding print sheet Pf is detected by the recording position detecting unit 12. T2 denotes the time that passes from the above-noted reference timing to the detection of the rear end of the print sheet P. T3 denotes the time that passes from the detection of a reference hole line to the detection of a next reference hole line. Then, the main control unit 501 selects non-printing discharge data as illustrated in FIG. 11.

FIG. 11 corresponds to the example of suction hole lines illustrated in FIG. 9. What is shown in FIG. 11 is only an example. Data selection differs depending on the relative positional relationship between the recording position detecting unit 12 and the mark detecting unit 16. Arrangement in the direction perpendicular to the sheet travel direction does not give rise to a problem in terms of non-printing discharge control.

When the main control unit 501 selects the suction hole line closest to the rear end of the print sheet P (i.e., the suction hole line B6 in the example illustrated in FIG. 9), the time taken for the suction hole line B6 to reach the position of the recording head 51Y is obtained through computation. The recording head 51Y starts performing non-printing discharge toward the suction holes 201 of the suction hole line B6 upon the passage of the calculated time. In this case, the pattern 12 illustrated in FIG. 10 is selected by the main control unit 501, so that non-printing discharge is performed with respect to the nine lines starting at the suction hole line B6 and ending at the suction hole line B2.

In this case also, the nine lines include at least one suction hole line (i.e., the reference hole line A1) that corresponds the positions of the nozzles 102*a* situated in an overlapping area between two adjacent heads 101 arranged in a staggered manner and the infrequently used nozzles 102*b* situated at the ends in the head arrangement direction. Accordingly, it is ensured that the nozzles 102*a* and 102*b* situated in these areas be able to perform non-printing discharge with definite certainty as in the previous embodiment. The nine lines may include suction holes that are different from the suction holes designed to match the positions of the nozzles situated at overlapping positions and the infrequently used nozzles situated at the array ends, but that come into being due to the structure of the suction hole array to match the positions of these nozzles. In such a case, the non-printing discharge data is configured such that only these suction holes do not perform non-printing discharge.

Non-printing discharge is performed similarly with respect to other recording heads 51M, 51C, and 51K, so that non-printing discharge for all the nozzles is completed. Further, sheet travel timing is controlled such that the front end of the next print sheet P does not interfere with the ninth suction hole line that is the last line of the above-noted suction hole lines being subjected to non-printing discharge.

The above description has been given by taking an example in which the suction hole line B6 is selected as the first suction hole line subjected to non-printing discharge. In order to provide margin for computation, the suction hole line A7 next following the suction hole line B6 may be selected.

Figure 12:
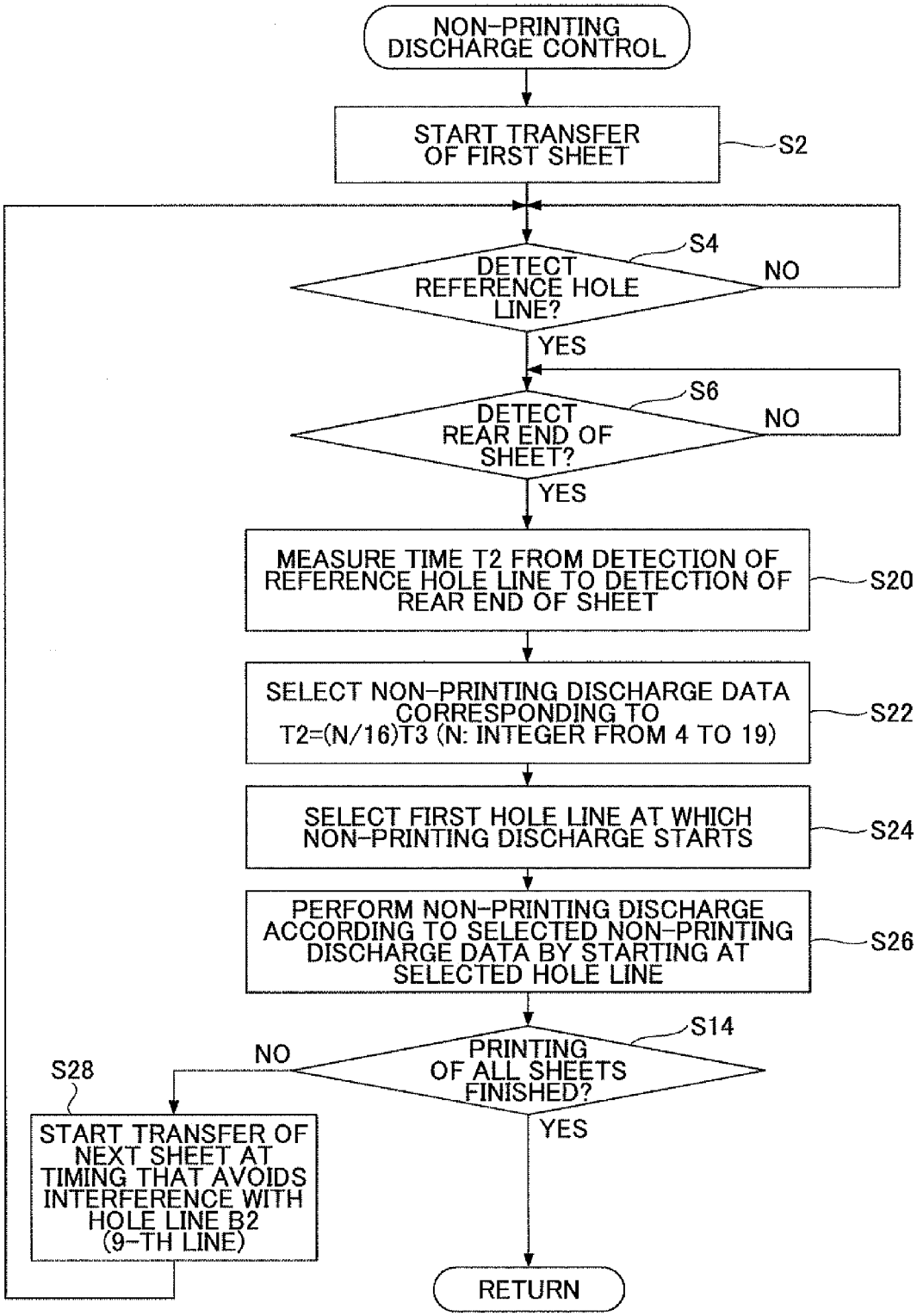
FIG. 12 is a flowchart illustrating the control of non-printing discharge operations.

In the following, the control of non-printing discharge will be described by referring to a flowchart illustrated in FIG. 12.

The main control unit 501 starts the transfer of a first print sheet Pf (step S2) (see FIG. 9). The main control unit 501 checks whether the mark detecting unit detects a hole mark 17 (step S4). Upon detecting a hole mark 17, the main control unit 501 checks whether the rear end Pfb of the first print sheet P is detected by the recording position detecting unit 12 (step S6).

Upon the rear end of the print sheet Pfb being detected by the recording position detecting unit 12, the main control unit 501 measures time T2 from the detection of the reference hole line A1 to the detection of the rear end of the print sheet Pf (step S20). The main control unit 501 then selects non-printing discharge data corresponding to T2=(N/16)T3 (N: integer from 4 to 19). The main control unit 501 then selects the first suction hole line (e.g., the suction hole line B6 in the example illustrated in FIG. 9) that is the first to be subjected to non-printing discharge (step S24). Non-printing discharge is performed according to the selected non-printing discharge data for which the selected suction hole line is the first line (step S26).

Thereafter, a check is made as to whether printing of all the print sheets has been completed (step S14). If printing of all the print sheets is not yet completed (No in step S14), the main control unit 501 starts the transfer of a next print sheet (step S28) at such timing as the front end Psa of the next print sheet Ps does not interfere with the suction hole line B2 or A3 (i.e., ninth line).

[First Implementation]

Figure 13:
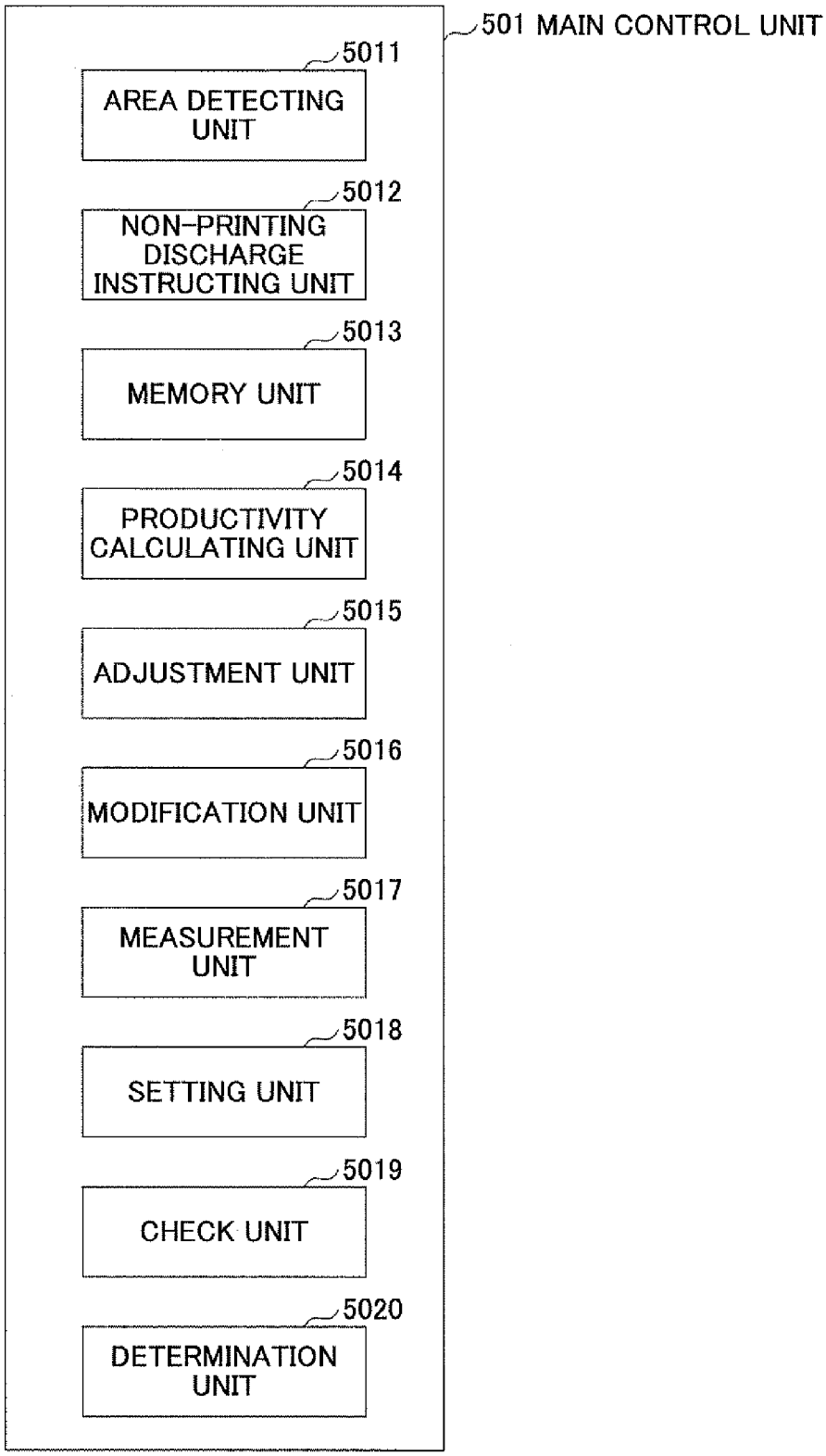
FIG. 13 is a drawing illustrating an example of the functional configuration of a main control unit.

In the following, a first implementation of the present embodiment will be described. FIG. 13 is a drawing illustrating an example of the functional configuration of the main control unit 501 according to the present embodiment. In the example illustrated in FIG. 13, the main control unit 501 includes an area detecting unit 5011, a non-printing discharge instructing unit 5012, a memory unit 5013, a productivity calculating unit 5014, an adjustment unit 5015, a modification unit 5016, a measurement unit 5017, a setting unit 5018, and a check unit 5019.

Figure 14:
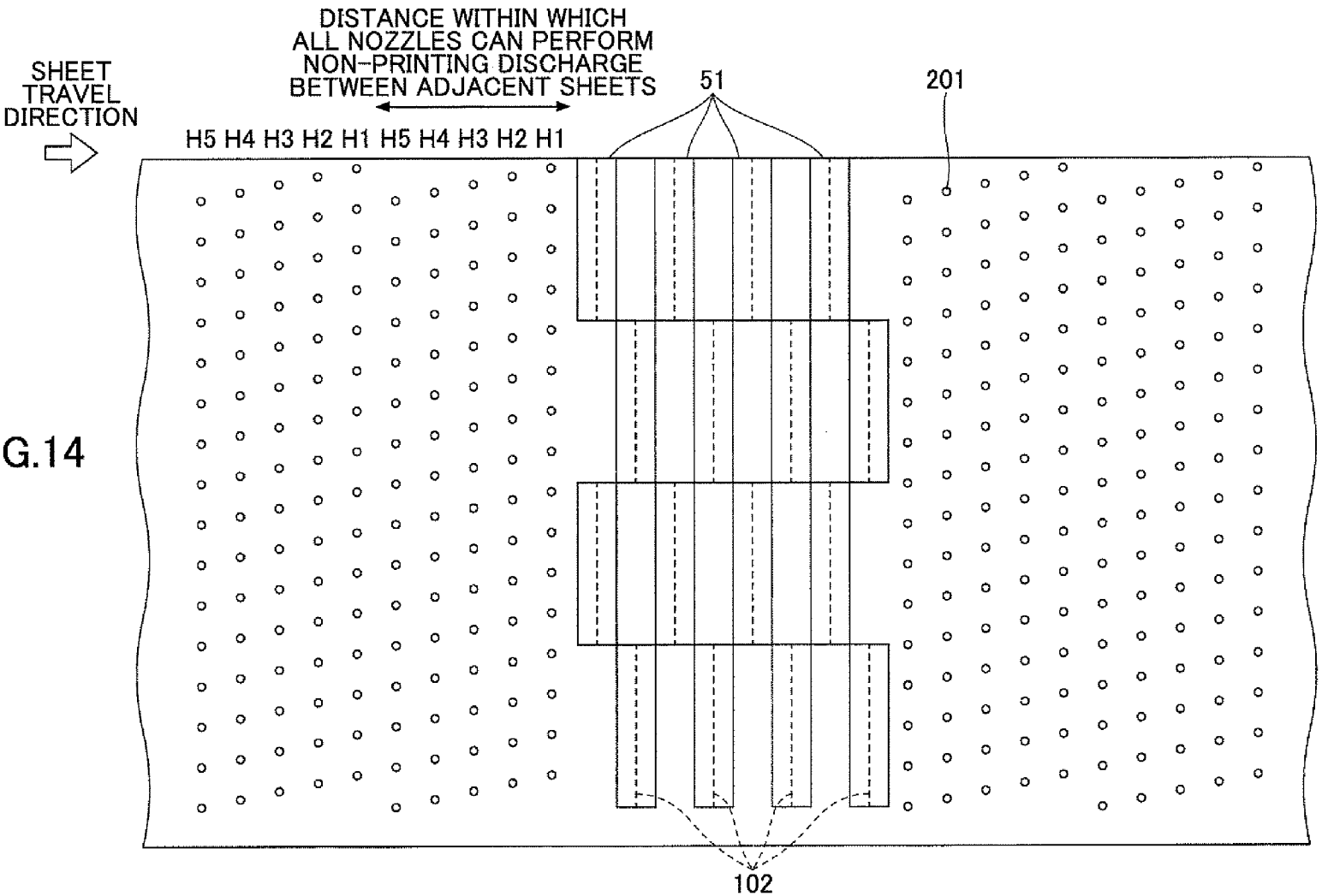
FIG. 14 is a drawing schematically illustrating a transfer belt, holes, and recording heads.

FIG. 14 is a drawing schematically illustrating the recording heads 51 and the holes 201 of the transfer unit 4 according to the present embodiment. As illustrated in FIG. 14, the transfer belt 43 moves under the recording heads 51 and the nozzles 102. In FIG. 14, the transfer belt 43 moves from the left-hand side to the right-hand side.

As describe above, the transfer belt 43 has the holes 201, which are for attaching a print sheet, and also allow the passage of ink squirted by non-printing discharge. The holes 201 are arranged to form lines extending in the direction perpendicular to the sheet travel direction. The lines of the holes form one cycle, i.e., H1 through H5, over a distance $\alpha$, within which all the nozzles can perform non-printing discharge at a single space between two adjacent sheets. In the following, a space between adjacent sheets may be referred to as a non-printing discharge area because of the fact that non-printing discharge is performed in such a space.

For the sake of convenience of explanation, five lines are needed in this example to perform non-printing discharge from all the nozzles in a space between sheets. However, this number of lines varies depending on the arrangement of the nozzles 102 and the recording heads 51, and is not limited to five. It may be noted that holes are arranged by placing the focus on the distance within which non-printing discharge can be performed for all the nozzles in a single space between sheets. The number of lines does not matter as long as the requirement for the distance is satisfied.

A print sheet attached at the holes 201 to the transfer belt 43 moves under the recording heads 51 due to the movement of the transfer belt 43.

Figure 15:
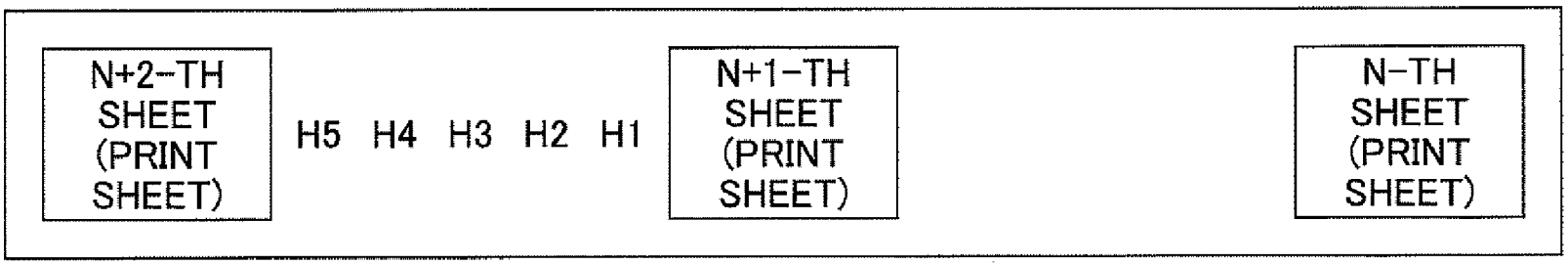
FIG. 15 is a drawing illustrating related-art non-printing discharge.

FIG. 15 is an illustrative drawing illustrating non-printing discharge disclosed in Japanese Patent Application Publication No. 2009-111909. In this related-art technology, all nozzles perform non-printing discharge in a non-printing discharge area (i.e., space) between an N+1-th print sheet and an N+2-th print sheet, for example, as illustrated in FIG. 15. H1 through H5 illustrated in FIG. 15 may be equivalent to H1 through H5 illustrated in FIG. 14. In FIG. 15, nozzles corresponding to H1 through H5 perform non-printing discharge. In this technology, all the nozzles perform non-printing discharge in a single non-printing discharge area.

In some cases, however, a non-printing discharge area may not be created that is sufficiently wide for all the nozzles to perform non-printing discharge. In consideration of this, the image forming apparatus of the present embodiment is configured such that all the nozzles 102 perform non-printing discharge at least once even when only a narrow non-printing discharge area is created.

Figure 16:
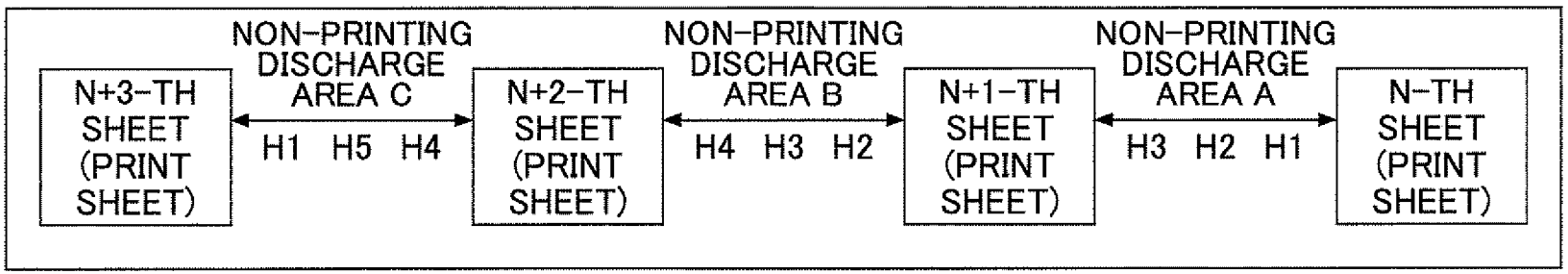
FIG. 16 is a drawing illustrating non-printing discharge according to an embodiment.

FIG. 16 is a drawing illustrating non-printing discharge of the present embodiment. As illustrated in FIG. 16, the main control unit 501 (see FIG. 13) detects a space between an N-th sheet and an N+1-th sheet as a non-printing discharge area A. The main control unit 501 detects a space between the N+1-th sheet and the N+2-th sheet as a non-printing discharge area B. The main control unit 501 detects a space between the N+2-th sheet and the N+3-th sheet as a non-printing discharge area C.

In the example illustrated in FIG. 16, the non-printing discharge instructing unit 5012 (see FIG. 13) causes the nozzles 102 corresponding to H1, H2, and H3 to perform non-printing discharge in the non-printing discharge area A. Further, the non-printing discharge instructing unit 5012 causes the nozzles 102 corresponding to H2, H3, and H4 to perform non-printing discharge in the non-printing discharge area B. Moreover, the non-printing discharge instructing unit 5012 causes the nozzles 102 corresponding to H1, H5, and H4 to perform non-printing discharge in the non-printing discharge area C.

In this manner, the non-printing discharge instructing unit 5012 causes the nozzles 102 to perform non-printing discharge in a plurality of non-printing discharge areas (i.e., non-printing discharge areas A through C in the example illustrated in FIG. 16) such that all the nozzles 102 perform non-printing discharge at least once.

Figure 32:
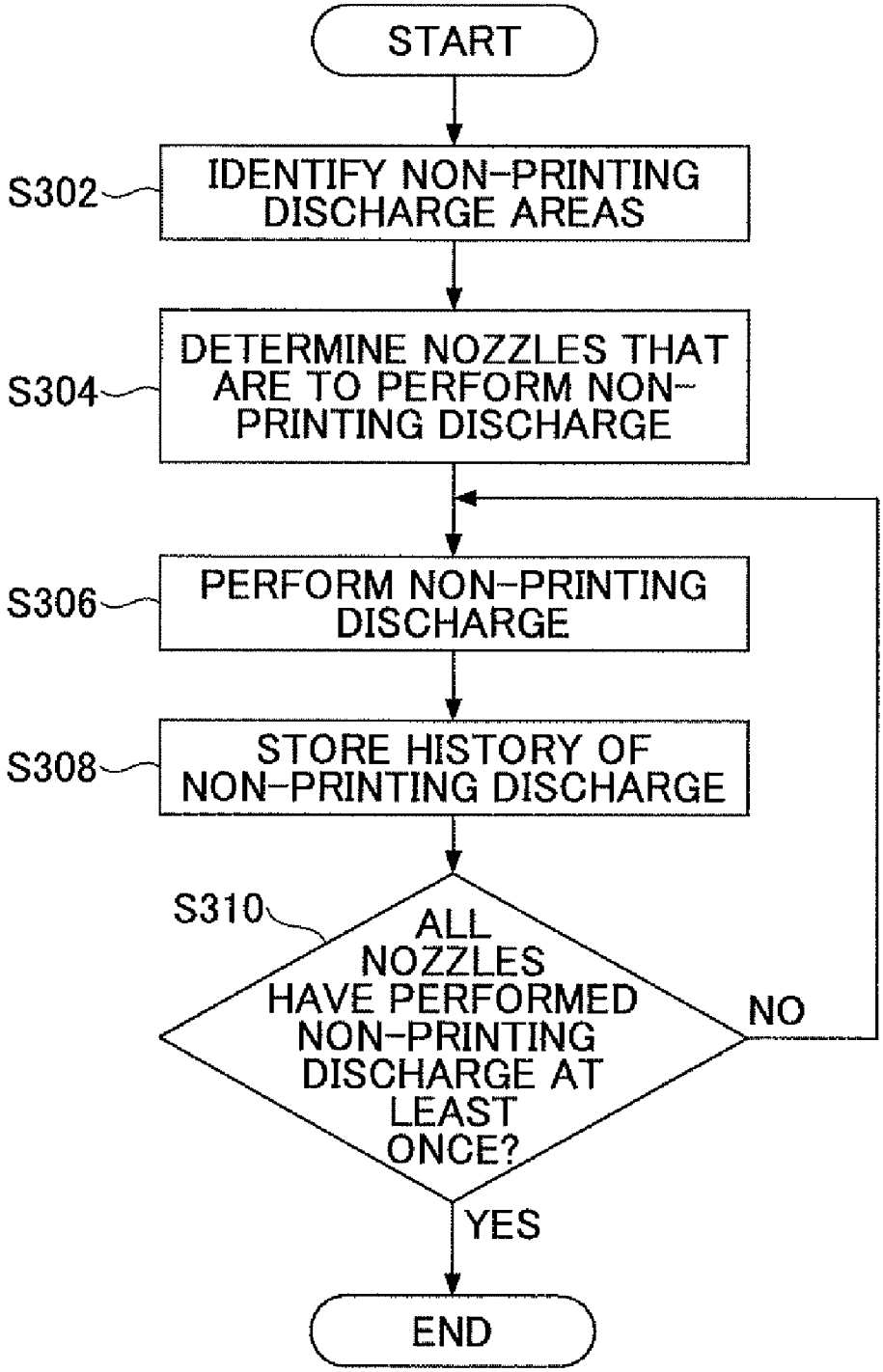
FIG. 32 is a flowchart illustrating non-printing discharge according to the embodiment.

In the following, a description will be given of a method of detecting a plurality of non-printing discharge areas by use of the area detecting unit 5011 and non-printing discharge performed based on such a detection method. FIG. 32 is a flowchart illustrating a main procedure relating to the detection of non-printing discharge areas and the performing of non-printing discharge. In this example, the area detecting unit 5011 detects a plurality of non-printing discharge areas based on the size of recording medium (e.g., print sheets) and the travel speed of the transfer belt 43. Such a detection may alternatively be performed based on other type of information. A plurality of non-printing discharge areas may be detected. Upon starting printing, the main control unit 501 acquires information about the size of the print sheet. The size of the print sheet is specified by a user operating the operation unit 507 (see FIG. 6). The main control unit 501 also detects the speed of the transfer belt 43. The detection of speed may be performed by use of a velocity sensor. The area detecting unit 5011 detects a plurality of non-printing discharge areas based on the size of recording medium (e.g., print sheets) and the travel speed of the transfer belt 43 (step S302).

Upon non-printing discharge areas being detected by the area detecting unit 5011, the non-printing discharge instructing unit 5012 determines (i.e., selects) the nozzles 102 that perform non-printing discharge based on the positions of the detected non-printing discharge areas, the number of input images, the intervals of the holes 201 of the transfer belt 43, and the positions of the holes 201 of the transfer belt 43 (step S304). The number of images may be counted by the main control unit 501. The intervals of the holes 201 (i.e., the distance between adjacent holes) are known in advance, and may be stored in the memory unit 5013 beforehand. The positions of the holes 201 of the transfer belt 43 may be detected by the mark detecting unit 16 when the mark detecting unit 16 detects the hole marks 17. In the following, information about which holes 201 are situated in which non-printing discharge areas will be referred to as "non-printing-discharge-area-&-hole information". Non-printing-discharge-area-&-hole information can be collected at the start of printing. Namely, the non-printing-discharge-area-&-hole information is stored in the memory unit 5013 of the main control unit 501 at the start of a printing procedure. The non-printing discharge instructing unit 5012 then causes the nozzles 102 to perform non-printing discharge by referring to the non-printing-discharge-area-&-hole information stored in the memory unit 5013 (step S306).

A history of non-printing discharge, which indicates nozzles having performed non-printing discharge, may be stored in the memory unit 5013 (FIG. 13) (step S308). The non-printing discharge instructing unit 5012 may request non-printing discharge based on the history of non-printing discharge stored in the memory unit 5013. The use of history of non-printing discharge can reduce the number of nozzles which have failed to perform non-printing discharge.

Subsequently, the determination unit 5020 checks whether all the nozzles have performed non-printing discharge at least once (step S310). Upon detection by the determination unit 5020 that all the nozzles have performed non-printing discharge at least once (Yes in step S310), the procedure comes to an end. Upon detection by the determination unit 5020 that not all the nozzles have performed non-printing discharge at least once (No in step S310), the procedure returns to step S306. In this manner, the non-printing discharge instructing unit 5012 ensures that all the nozzles perform non-printing discharge at least once.

In the following, various implementations of non-printing discharge will be described.

<Standard Non-Printing Discharge>

In the following, a description will be given of standard non-printing discharge according to the present embodiment. FIG. 17 is a drawing illustrating standard non-printing discharge. In the example illustrated in FIG. 17, the nozzles 102 corresponding to holes H1, H2, and H3 perform non-printing discharge in the non-printing discharge area A. Further, the nozzles 102 corresponding to holes H4 perform non-printing discharge in the non-printing discharge area B. Moreover, the nozzles 102 corresponding to holes H5 perform non-printing discharge in the non-printing discharge area C.

<Non-Printing Discharge for Distributing Load of Recording Heads>

FIG. 18 is a drawing illustrating non-printing discharge for distributing the load of the recording heads 51 according to the present embodiment. In the example illustrated in FIG. 18, the nozzles 102 corresponding to holes H3 perform non-printing discharge in the non-printing discharge area A. Further, the nozzles 102 corresponding to holes H2 and H4 perform non-printing discharge in the non-printing discharge area B. Moreover, the nozzles 102 corresponding to holes H1 and H5 perform non-printing discharge in the non-printing discharge area C.

In this manner, the number of nozzles performing non-printing discharge may be kept to a minimum, thereby distributing the load of the recording heads. In the non-printing discharge areas A, B, and C illustrated in FIG. 17, the number of nozzles 102 performing non-printing discharge is 3, 1, and 1, respectively. On the other hand, the number is 1, 2, and 2 in the non-printing discharge areas A, B, and C illustrated in FIG. 18, respectively. Accordingly, the method of performing non-printing discharge illustrated in FIG. 18 can reduce the load of the recording heads during non-printing discharge compared with the method of performing non-printing discharge illustrated in FIG. 17.

<Non-Printing Discharge for Giving Priority to Image Quality>

In the following, non-printing discharge for giving priority to image quality will be described. FIG. 19 is a drawing illustrating non-printing discharge for giving priority to image quality. In the example illustrated in FIG. 19, the nozzles 102 corresponding to holes H1, H2, and H3 perform non-printing discharge in the non-printing discharge area A. Further, the nozzles 102 corresponding to holes H2, H3, and H4 perform non-printing discharge in the non-printing discharge area B. Moreover, the nozzles 102 corresponding to holes H1, H4, and H5 perform non-printing discharge in the non-printing discharge area C. The method of performing non-printing discharge illustrated in FIG. 17 ensures speedy printing. In the example illustrated in FIG. 19, the amount of ink discharged for non-printing discharge is larger than in the examples illustrated in FIG. 17 and FIG. 18, thereby serving to improve the quality of images formed on print sheets.

<Mode Selection>

The method of performing non-printing discharge illustrated in FIG. 19 consumes a different amount of ink for non-printing discharge than the method of performing non-printing discharge illustrated in FIG. 17 and FIG. 18. In non-printing discharge for giving priority to image quality, the amount of consumed ink increases while image quality is improved. It may thus be preferable to let a user decide whether to select a high-quality image mode for non-printing discharge.

Figure 20:
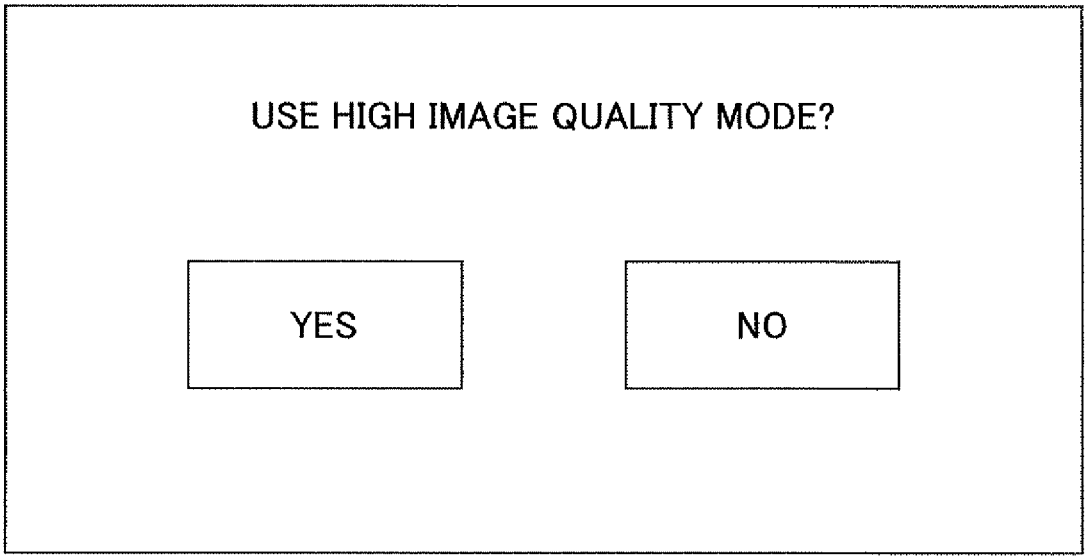
FIG. 20 is a drawing illustrating an example of a selection screen.

FIG. 20 is a drawing illustrating an example of a selection screen. In this example illustrated in FIG. 20, the screen allows a choice to be made as to whether to use the high image quality mode. When a user selects the high image quality mode by selecting "YES" in the example illustrated in FIG. 20, the method of performing non-printing discharge illustrated in FIG. 19 will be performed as was previously described.

When a user selects "NO", a method of performing non-printing discharge illustrated in either FIG. 17 or FIG. 18 will be performed. A button for selecting the method illustrated in FIG. 18 (i.e., the method of performing non-printing discharge for distributing the load of the recording heads 51) may be provided. The selection screen illustrated in FIG. 20 may be attached to a selecting unit $\mathbf{507}_2$ (see FIG. 6). The selecting unit $\mathbf{507}_2$ may be a touch-panel-type monitor which displays the selection screen illustrated in FIG. 20.

The image forming apparatus of the first implementation performs non-printing discharge in a piecewise manner by dividing the discharge operation into small portions when a space between sheets (i.e., the length of a non-printing discharge area) is shortened for the purpose of improving productivity. This allows all the nozzles to perform non-printing discharge.

[Second Implementation]

In the second implementation, the setting unit 5018 (see FIG. 13) stores a setting indicative of a print sheet that is frequently used by users. The area detecting unit 5011 detects a plurality of non-printing discharge areas based on the size of the print medium indicated by the setting of the setting unit 5018 and the speed of the transfer belt when a next image is formed. In the following, a method of making a setting to the setting unit 5018 will be described.

Figure 21:
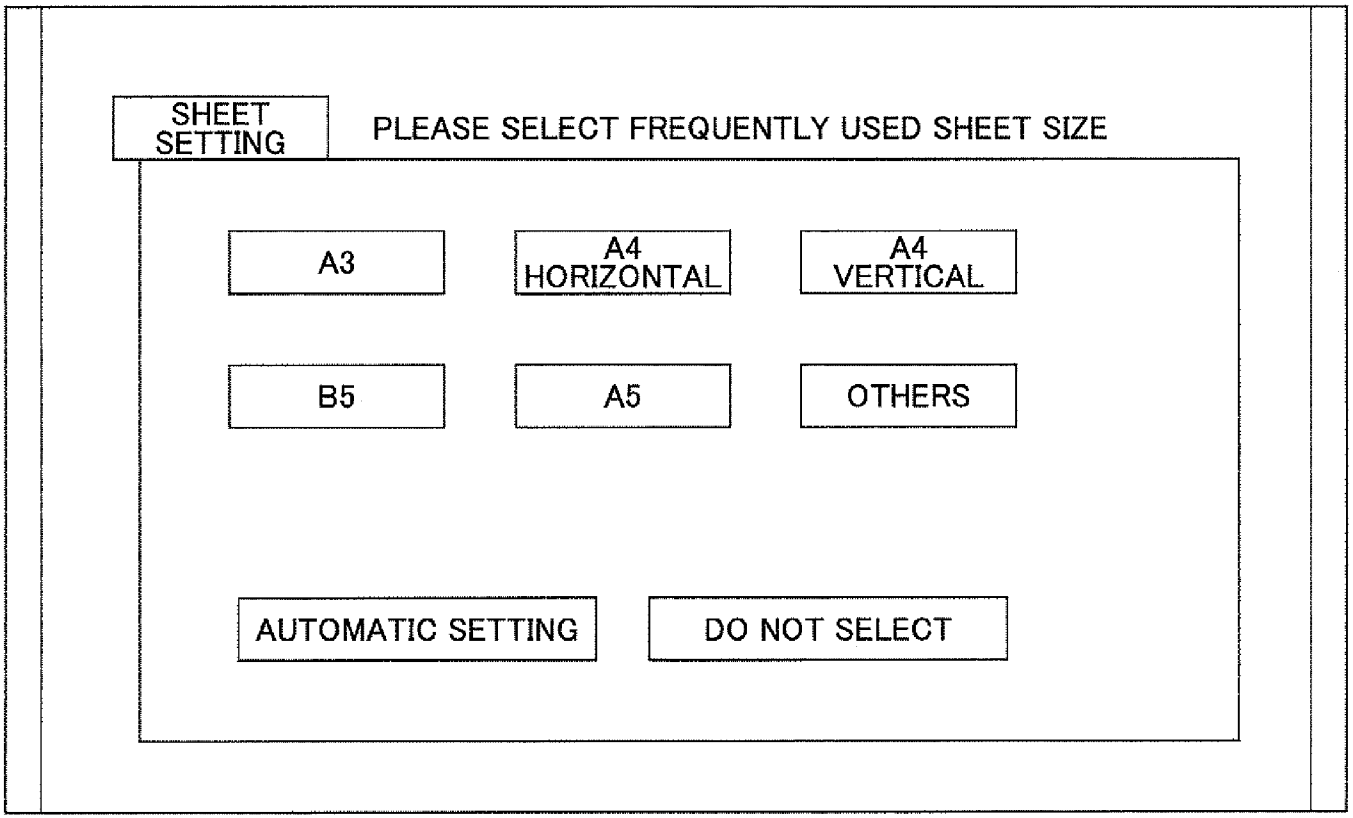
FIG. 21 is a drawing illustrating an example of a selection screen which allows a frequently used print sheet to be selected.

FIG. 21 is a drawing illustrating an example of a selection screen which allows a user to select a print sheet that is frequently used. The selection screen is displayed on the selecting unit $\mathbf{507}_2$. In the example illustrated in FIG. 21, A3, A4 horizontal, A4 vertical, and so on can be selected.

Figure 22:
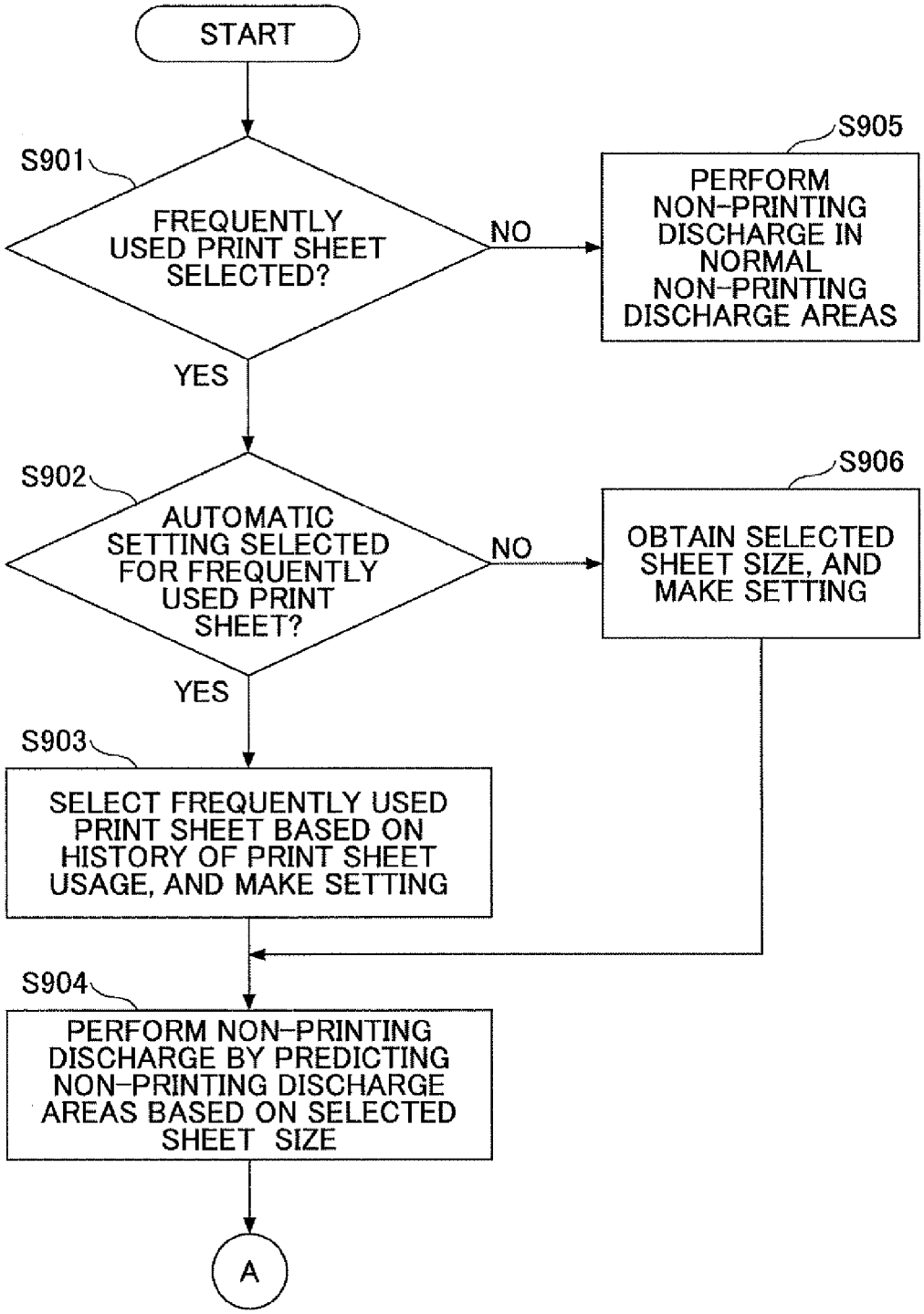
FIG. 22 is a flowchart illustrating a main procedure of a setting unit.
Figure 23:
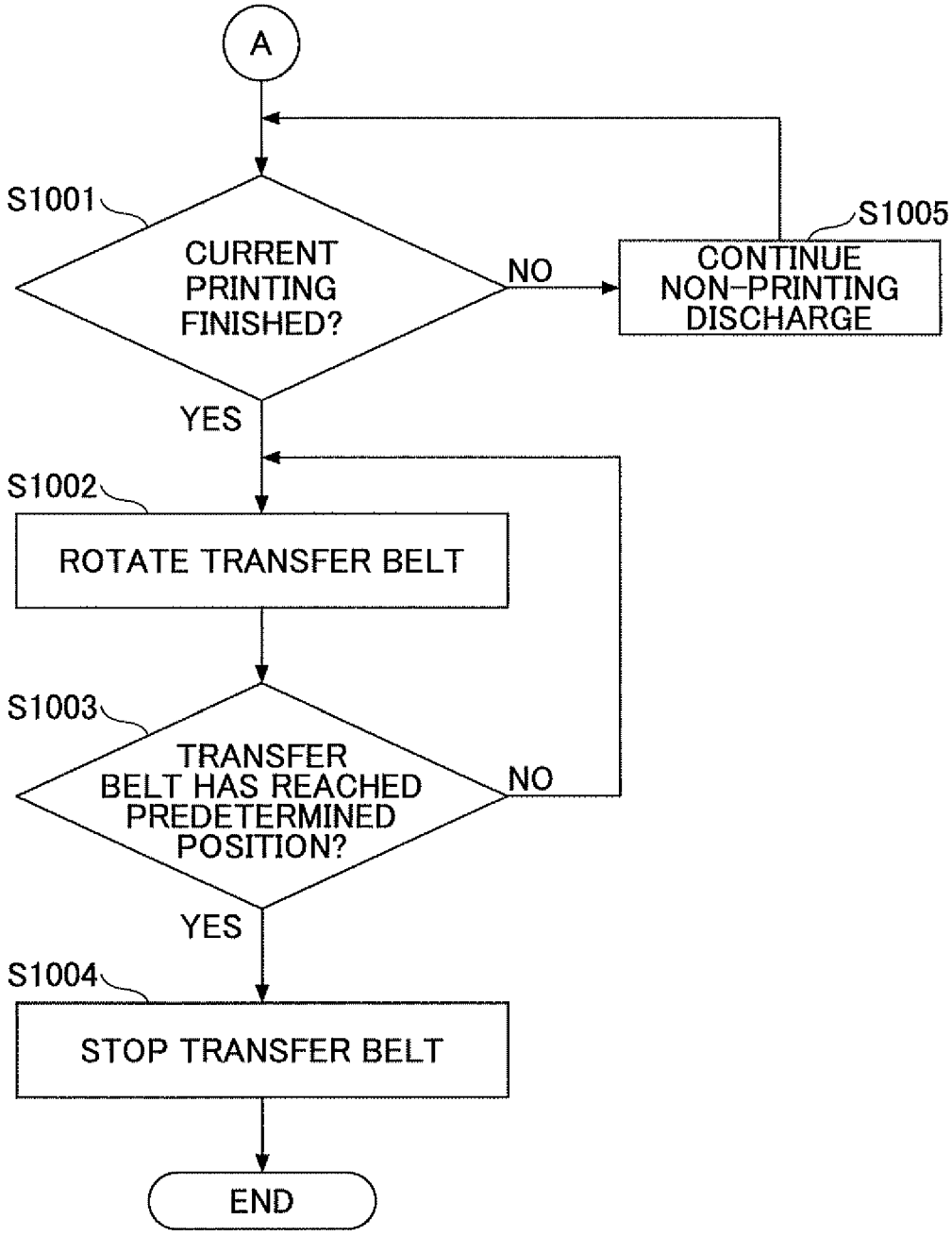
FIG. 23 is a flowchart illustrating a main procedure performed when a frequently used print sheet is selected.

Upon "automatic setting" being selected by a user, history of usage stored in the image forming apparatus may be used. If "do not select" is selected by a user, the process of the second implementation will not be performed. FIG. 22 and FIG. 23 are flowcharts illustrating a main procedure performed by the image forming apparatus of the second implementation. The main control unit 501 (see FIG. 6) checks whether a frequently used print sheet has been selected on the selection screen illustrated in FIG. 21 (step S901). Upon determining that no selection has been made (No in step S901), the main control unit 501 performs non-printing discharge toward standard non-printing discharge areas as was previously described (step S905).

Upon determining that a frequently used print sheet has been selected (Yes in step S901), the main control unit 501 checks whether the automatic setting (see FIG. 21) for a frequently used print sheet has been selected (step S902). If the automatic setting is not selected, the setting unit 5018 acquires information about the sheet size specified by the user, and makes a setting indicative of the acquired sheet size (step S906).

Upon determining that the automatic setting for a frequently used print sheet has been selected (Yes in step S902), the setting unit 5018 determines a frequently used print sheet based on the history of frequency of uses of print sheets stored in the memory unit 5013, and makes a setting indicative of the determined sheet (step S903). The area detecting unit 5011 detects a plurality of non-printing discharge areas based on the sheet size set in step S903 or S906 and the speed of the transfer belt 43. The non-printing discharge instructing unit 5012 then requests non-printing discharge to be performed with respect to the detected non-printing discharge areas (step S904).

If the setting unit 5018 stores a setting indicative of a selected frequently used sheet size, the area detecting unit 5011 detects non-printing discharge areas based on the selected frequently used sheet size and the travel speed of the transfer belt 43 when a next image is formed. On the next occasion of forming images, thus, there is no need to devote the time and labor to acquire a sheet size.

FIG. 23 is a flowchart illustrating a next image forming process. The main control unit 501 checks whether the current print process is completed (step S1001). Upon detecting that the current print process is not completed, the main control unit 501 continues non-printing discharge (step S1005).

Upon detecting that the current print process is completed (Yes in step S1001), the main control unit 501 rotates the transfer belt 43 for the purpose of detecting the position of the holes 201 of the transfer belt 43 before stopping the transfer belt 43 (step S1002). The main control unit 501 checks whether the transfer belt 43 has reached a predetermined position (step S1003). The predetermined position refers to such a position that optimum non-printing discharge can be performed in non-printing discharge areas when a frequently used sheet size is selected. Upon the transfer belt 43 reaching the predetermined position (Yes in step S1003), the main control unit 501 stops the transfer belt 43 (step S1004). The main control unit 501 continues to rotate the transfer belt 43 until the transfer belt 43 reaches the predetermined position (No in step S1003).

In the second implementation, the setting unit 5018 makes a setting indicative of a frequently used print sheet, so that there is no need for the main control unit 501 to perform the process of acquiring a sheet size.

[Third Implementation]

The first and second implementations are directed to non-printing discharge that is performed with respect to a plurality of non-printing discharge areas. In some cases, however, not all the nozzles can perform non-printing discharge in the non-printing discharge areas.

Figure 24:
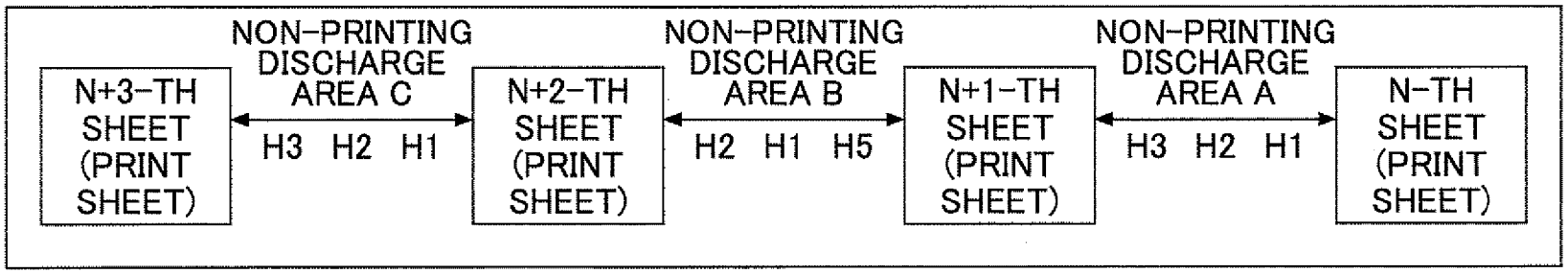
FIG. 24 is a drawing illustrating a situation in which not all the nozzles can perform non-printing discharge in non-printing discharge areas.
Figure 25:
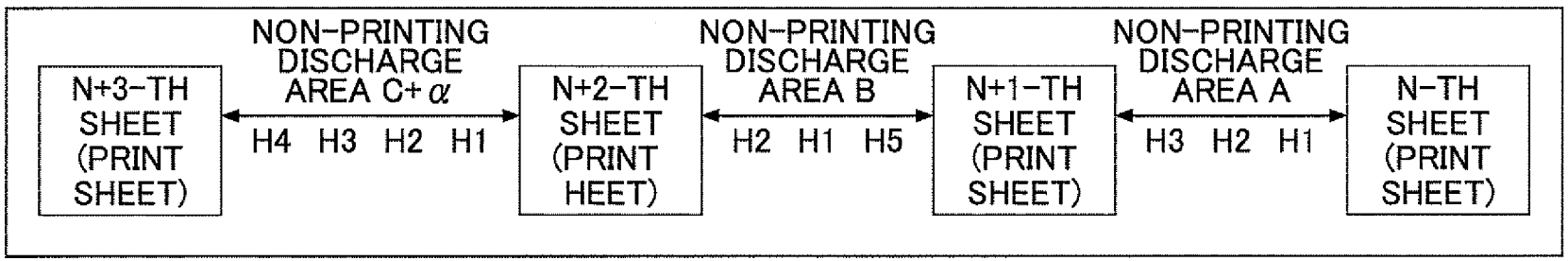
FIG. 25 is a drawing illustrating an enlarged non-printing discharge area.

FIG. 24 is a drawing illustrating a case in which not all the nozzles perform non-printing discharge. In the example illustrated in FIG. 24, the nozzles corresponding to H4 do not perform non-printing discharge in any one of the three non-printing discharge areas A, B, and C. In the third implementation, at least one of the non-printing discharge areas is modified to change its extent thereby to allow all the nozzles to perform non-printing discharge. Here, the extent of a non-printing discharge area is the length of the non-printing discharge area in the travel direction of the transfer belt 43. FIG. 25 is a drawing illustrating non-printing discharge after the adjustment of non-printing discharge areas. In the example illustrated in FIG. 25, the extent of the non-printing discharge area C is enlarged (i.e., by $+\alpha$ as illustrated in FIG. 25).

Enlarging the extent of a non-printing discharge area results in the productivity of the image forming apparatus being lowered. Productivity may be measured by copy speed, which is represented by CPM (copy per minute). In the third implementation, the image forming apparatus enlarges the extent of a non-printing discharge area without dropping the productivity of the image forming apparatus.

Figure 26:
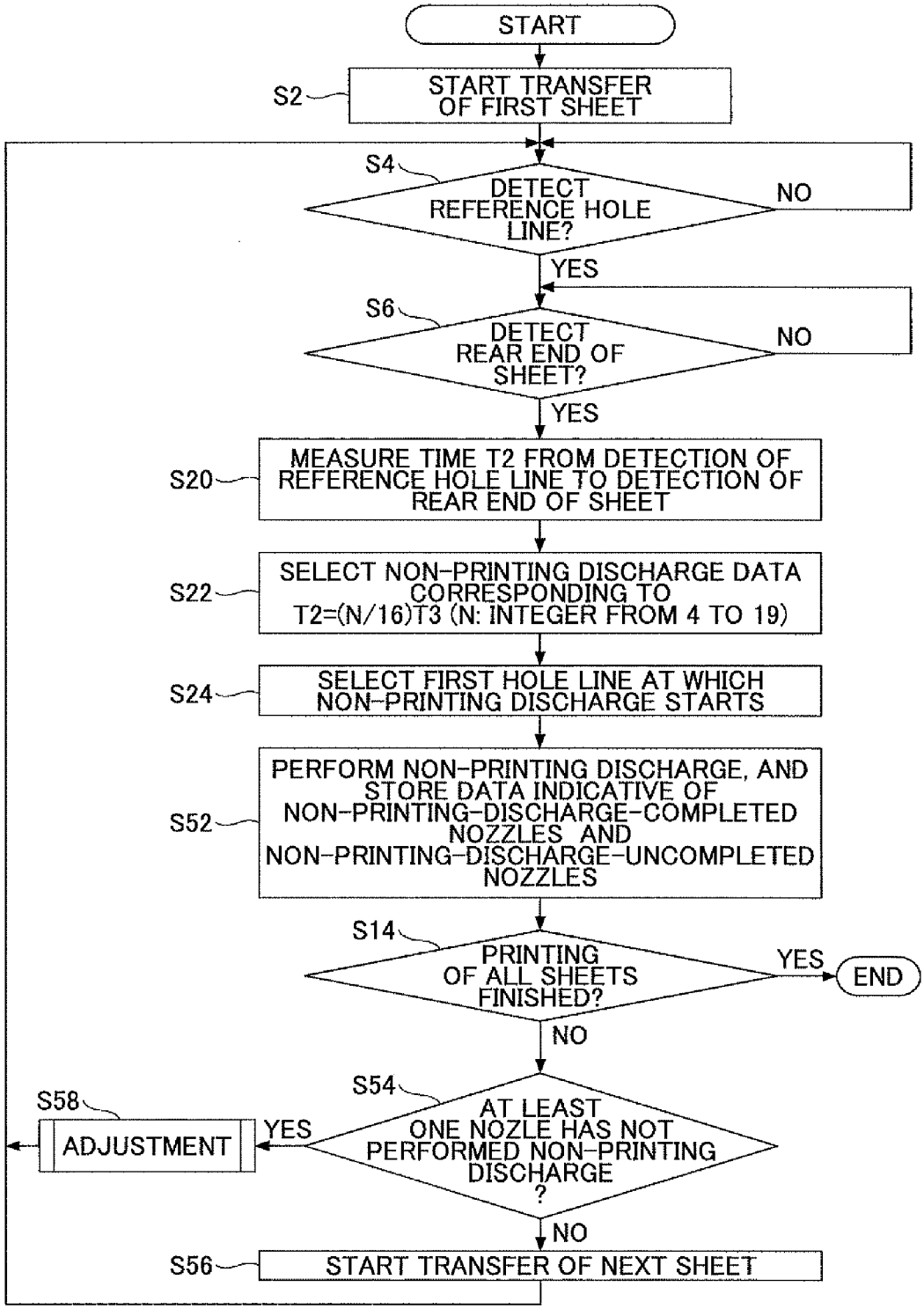
FIG. 26 is a flowchart illustrating a main procedure performed by the image forming apparatus of another implementation.

FIG. 26 is a flowchart illustrating a main procedure performed by the image forming apparatus of the third implementation. Processes performed in step S2 to step S24 are the same as those illustrated in FIG. 12, and a description thereof will be omitted. Upon non-printing discharge being performed, the non-printing discharge instructing unit 5012 stores, in the memory unit 5013 (see FIG. 13), information indicative of nozzles having performed non-printing discharge (hereinafter referred to as "non-printing-discharge-completed nozzles") and nozzles having not performed non-printing discharge (hereinafter referred to as "non-printing-discharge-uncompleted nozzles") (step S52). In other words, data indicative of non-printing-discharge-completed nozzles 201 and non-printing-discharge-uncompleted nozzles 201 are stored in memory unit 5013.

If printing of all the print sheets is completed (Yes in step S14), the procedure comes to an end. If printing of all the print sheets is not yet completed (No in step S14), the check unit 5019 checks whether there is a nozzle that has not performed non-printing discharge (step S54). In other words, the check unit 5019 checks whether all the nozzles have performed non-printing discharge (step S54). Upon determining that all the nozzles have performed non-printing discharge (No in step S54), the transfer of a next print sheet is started at the timing that gives priority to productivity (step S56). Upon determining that at least one nozzle has not yet performed non-printing discharge (Yes in step S54), the extent of a non-printing discharge area and the travel speed of the transfer belt 43 are adjusted (step S58).

Figure 27:
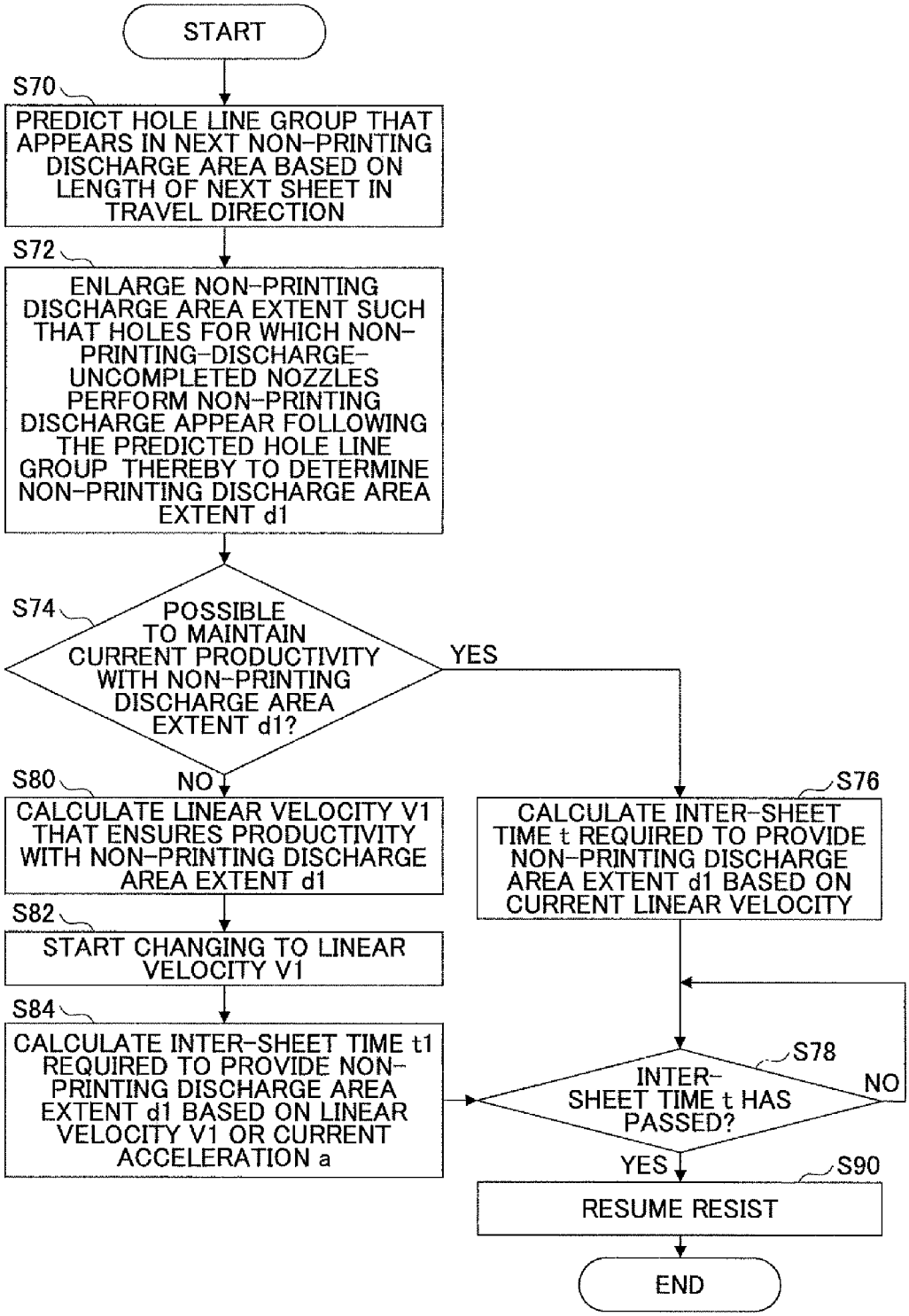
FIG. 27 is a flowchart illustrating a main procedure performed to adjust the extent of a non-printing discharge area.

FIG. 27 is a flowchart illustrating an example of the process of adjusting the travel speed of the transfer belt according to the present implementation. In FIG. 27, the travel speed of the transfer belt 43 is linear velocity.

The area detecting unit 5011 detects a set of hole lines appearing in the next non-printing discharge area based on the length of the next print sheet in the sheet travel direction (step S70). The set of hole lines refers to a group of hole lines such as A1 through A5 illustrated in FIG. 2.

The adjustment unit 5015 enlarges the extent of the non-printing discharge area to create a new non-printing discharge area extent d1 such that holes for which the non-printing-discharge-uncompleted nozzles are to perform discharge appear after the detected set of hole lines. Here, the non-printing discharge area extent is the length of the non-printing discharge area in the travel direction of the transfer belt 43.

Subsequently, the productivity calculating unit 5014 calculates current productivity. The productivity may be defined as copy speed CPM. Productivity K may be obtained by use of the following formula.

$$\text{Productivity } K = \text{Linear Velocity } V/(\text{sheet length in travel direction distance between sheets})$$

The adjustment unit 5015 then checks whether the current productivity can be maintained upon using the non-printing discharge area extent d1 obtained in step S72. An example of the method of checking whether the productivity can be maintained will be described below. A productivity range is determined in advance for each different sheet size. In the case of the A4 print sheet, for example, a productivity range may be set to $\alpha 1$ to $\alpha 2$. In the case of the B4 print sheet, a productivity range may be set to $\beta 1$ to $\beta 2$. The main control unit 501 may acquire a sheet size and then determine whether the productivity falls within a predetermined productivity range corresponding to the acquired sheet size. The productivity ranges may be stored in the memory unit 5013.

Upon determining that the productivity can be maintained (Yes in step S74), the adjustment unit 5015 calculates time t required to provide the non-printing discharge area extent d1 based on a current linear velocity V. The time t will hereinafter be referred to as "inter-sheet time (inter-recording-medium time)". Namely, the non-printing discharge area extent d1 is provided by providing the passage of the inter-sheet time t. Specifically, the inter-sheet time t is obtained by use of the following formula.

$$t = d1/V \quad (1)$$

The main control unit 501 waits until the inter-sheet time t passes (step S78). With the passage of the inter-sheet time t, the non-printing discharge area extent d1 is secured. With this arrangement, the non-printing-discharge-uncompleted nozzles can perform non-printing discharge. Since the non-printing discharge area extent is adjusted, the adjustment of resist is resumed (step S90).

Upon detecting that the current productivity cannot be maintained with the non-printing discharge area extent d1 (No in step S74), the modification unit 5016 calculates a linear velocity V1 that can maintain the productivity with the non-printing discharge area extent d1. The modification unit 5016 starts changing the linear velocity to V1 (step S82). The adjustment unit 5015 calculates inter-sheet time t1 required to provide the non-printing discharge area extent d1 based on the linear velocity V1 and an acceleration a of the transfer belt 43 (step S84). The procedure then proceeds to step S78. Upon completion of the process in step S90, the procedure returns to step S4 illustrated in FIG. 26.

As described above, the adjustment unit 5015 preferably adjusts the linear velocity such that the time (i.e., inter-sheet time t1) required to provide the post-adjustment non-printing discharge area extent d1 falls within a predetermined range. This ensures that the inter-sheet time t1 does not become excessively large or small, which causes productivity to be excessively small or large. The predetermined time range may be determined in advance and stored in the memory unit 5013. The time range may be determined such that productivity falls within the above-described productivity range.

In the following, a description will be given of a second print sheet. The reference hole line is detected in step S4, and the rear end of the print sheet is detected in step S6. Prior to the resumption of resist in step S90 of FIG. 27, the reference hole line and the rear end of the print sheet may have already been detected. In such a case, the process in step S24 of FIG. 26 is already completed. When non-printing discharge data is selected in step S22, either process (A) or process (B) shown below may be performed. (A) The non-printing-discharge-completed nozzles also perform non-printing discharge again according to the non-printing discharge data. (B) In order to avoid wasting ink, the non-printing discharge instructing unit 5012 masks the non-printing-discharge-completed nozzles to avoid second-time non-printing discharge.

The above description has been directed to the implementation in which productivity is taken into account. In the following, an implementation in which no consideration is given to productivity will be described. In this case, the check unit 5019 checks whether all the nozzles have performed non-printing discharge. Upon detecting that not all the nozzles have performed non-printing discharge (i.e., there is a nozzle that has not yet performed non-printing discharge), the adjustment unit 5015 adjusts the extent of the non-printing discharge area to ensure that all the non-printing-discharge-uncompleted nozzles perform non-printing discharge.

The speed of the transfer belt may also be adjusted. In this case, there is no need for the productivity calculating unit 5014 to perform productivity calculations. Computational cost can thus be reduced.

<Discharge Frequency>

In the following, discharge frequency will be described. The main control unit 501 performs non-printing discharge at discharge frequency synchronized with the linear velocity V. Slits for an encoder are marked on the belt rollers 41 and 42 illustrated in FIG. 1 to be scanned by an encoder. In synchronization with numerical values obtained by the scan, the main control unit 501 produces the discharge frequency. Namely, upon a change of the linear velocity V, the modification unit 5016 can modify the discharge frequency to follow the change and to maintain the resolution of sub-scans at a constant value. This makes it possible to perform non-printing discharge while the transfer belt 43 is accelerating.

Figure 28:
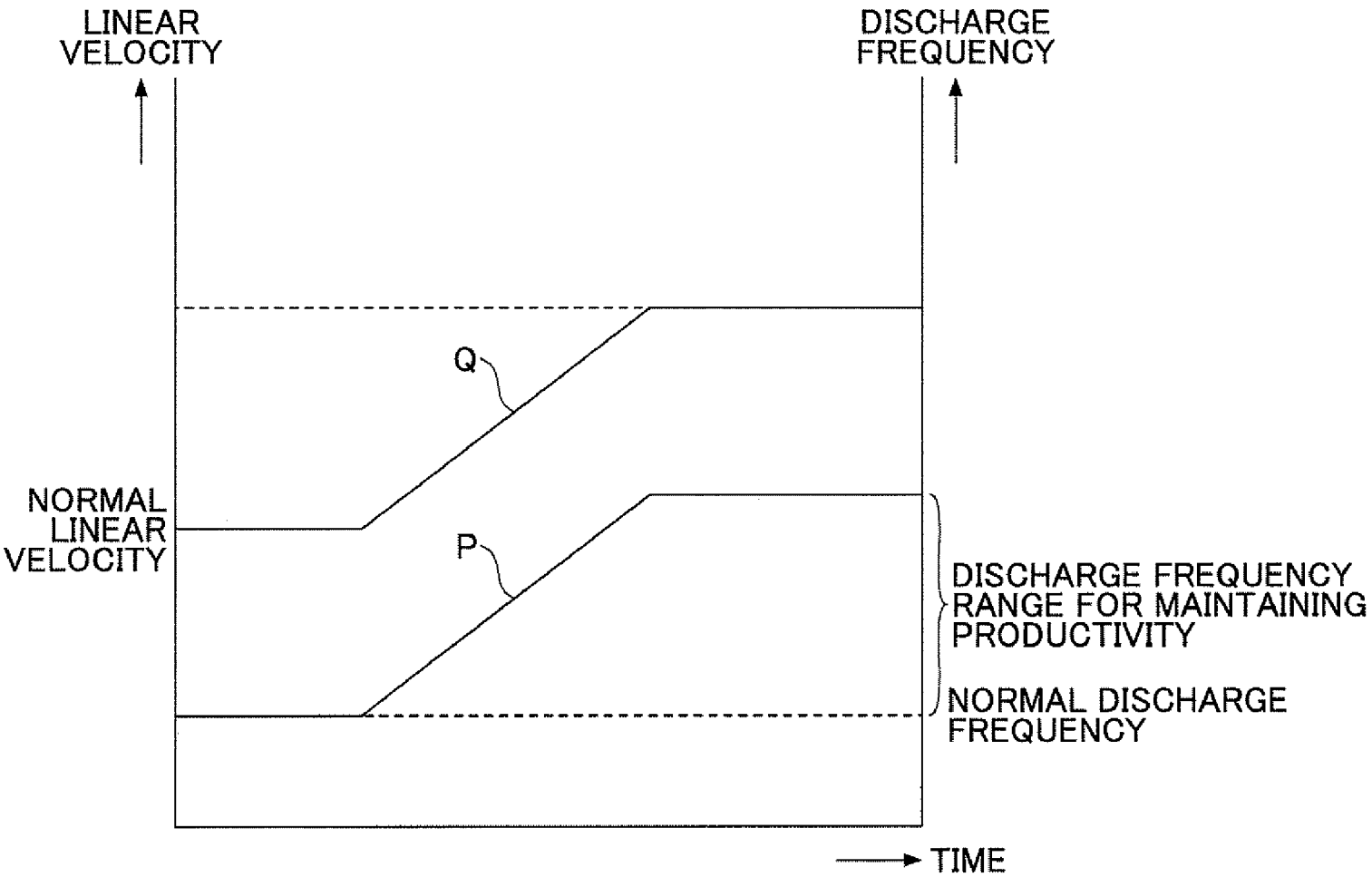
FIG. 28 is a drawing illustrating discharge frequency.

FIG. 28 is a drawing illustrating a change in discharge frequency synchronized with linear velocity. In FIG. 28, the horizontal axis represents time. The vertical axis on the left-hand side represents linear velocity, and the vertical axis on the right-hand side represents discharge frequency. The lower dotted line indicates a normal discharge frequency. As linear velocity increases as illustrated in P, the modification unit 5016 modifies discharge frequency. In so doing, it is preferable for the adjustment unit 5015 to adjust linear velocity such that the discharge frequency stays within a predetermined frequency range. This is because discharge cannot be performed at frequency higher than a certain limit frequency. The predetermined frequency range may be determined through experiments, and may be stored in the memory unit 5013 in advance.

<Mode Change>

In the present implementation, either a mode A or a mode B may be used. In the mode A, the non-printing discharge instructing unit 5012 causes the nozzles to perform non-printing discharge in plural non-printing discharge areas. In the mode B, the non-printing discharge instructing unit 5012 causes the nozzles to perform non-printing discharge in a single non-printing discharge area. The mode A places more emphasis on productivity than does the mode B. The mode B places more emphasis on image quality than does the mode A. In the following, the mode A will be referred to as a productivity priority mode, and the mode B will be referred to as an image quality priority mode.

Figure 29:
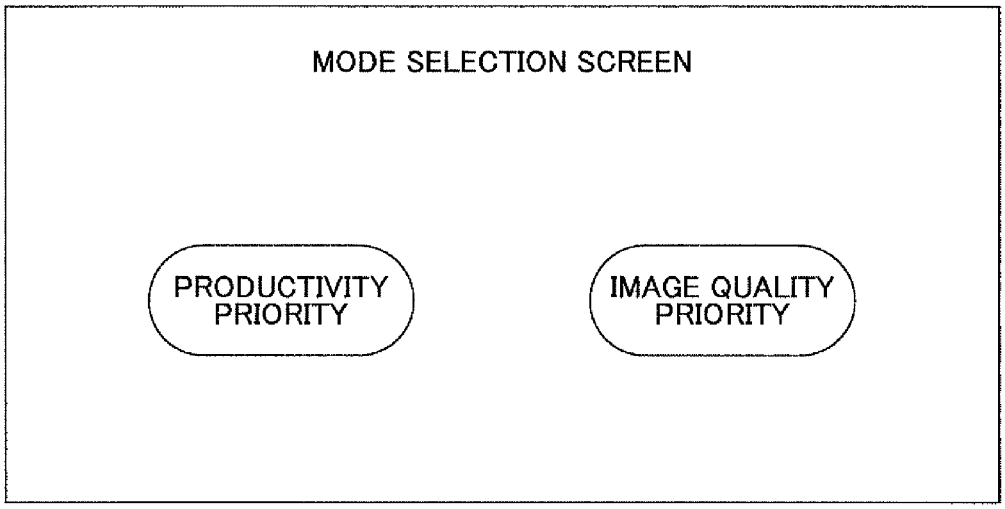
FIG. 29 is a drawing illustrating an example of a mode selection screen.

FIG. 29 is a drawing illustrating an example of a selection screen which allows a user to select the productivity priority mode or the image quality priority mode. The user may press a button indicative of a desired mode thereby to perform the desired mode. The selection screen illustrated in FIG. 29 may be displayed on the selecting unit $\mathbf{507}_2$ (see FIG. 6).

Figure 30:
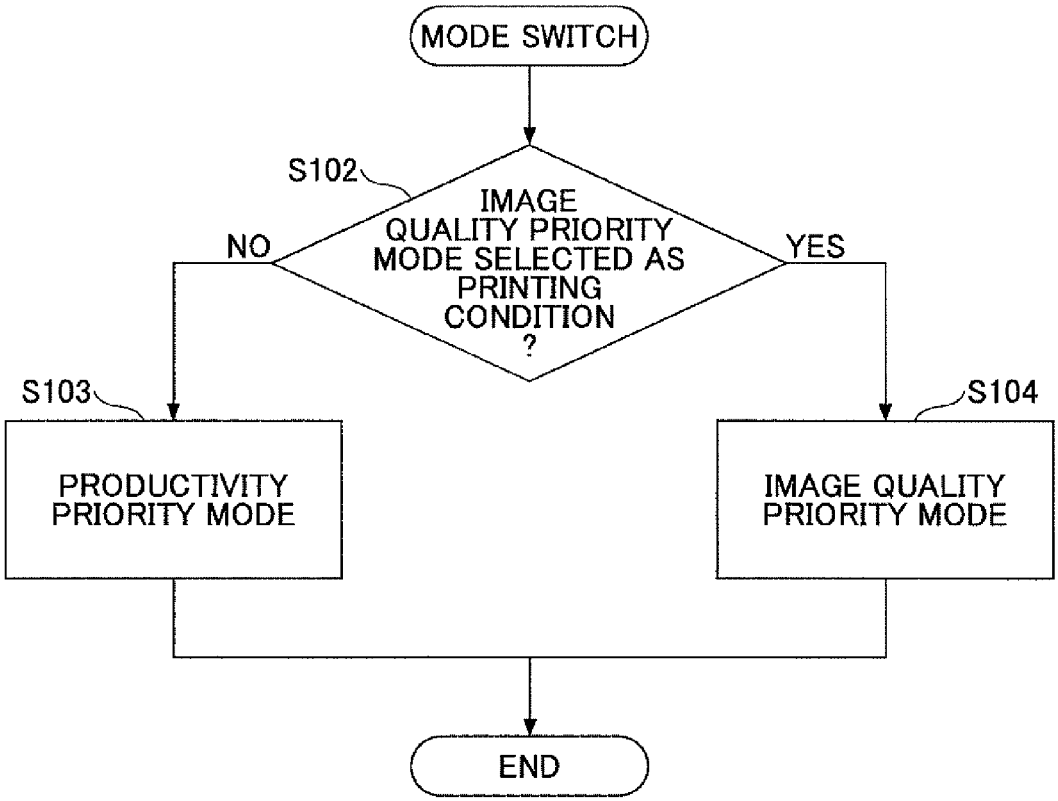
FIG. 30 is a flowchart illustrating a main procedure performed when the mode selection screen is used.

FIG. 30 is a flowchart illustrating a main procedure of the present implementation. The main control unit 501 checks whether the image quality priority mode has been selected at the selecting unit $\mathbf{507}_2$ as the printing conditions (step S102). In the case of the image quality priority mode being selected (Yes in step S102), the image quality priority mode is applied. Namely, the non-printing discharge instructing unit 5012 requests non-printing discharge to be performed with respect to a single non-printing discharge area (step S104).

In the case of the productivity priority mode being selected as the printing conditions (No in step S102), the productivity priority mode is applied. Namely, the non-printing discharge instructing unit 5012 causes all the nozzles to perform non-printing discharge in plural non-printing discharge areas (step S103).

With the capacity for a user to select either the productivity priority mode or the image quality priority mode, the image forming apparatus becomes user-friendly and easy to use.

<Switching Linear Velocities>

In general, frequent switching of linear velocities produces irregular noises, which gives unpleasant sensation to users. In this implementation, the image forming apparatus is configured to minimize the switching of linear velocities. Specifically, the measurement unit 5017 (see FIG. 13) continuously measures productivity during the period in which a predetermined number of N print sheets are printed. If the productivity does not fall within the predetermined productivity range during this period, the non-printing discharge area extent and linear velocity are modified.

Figure 31:
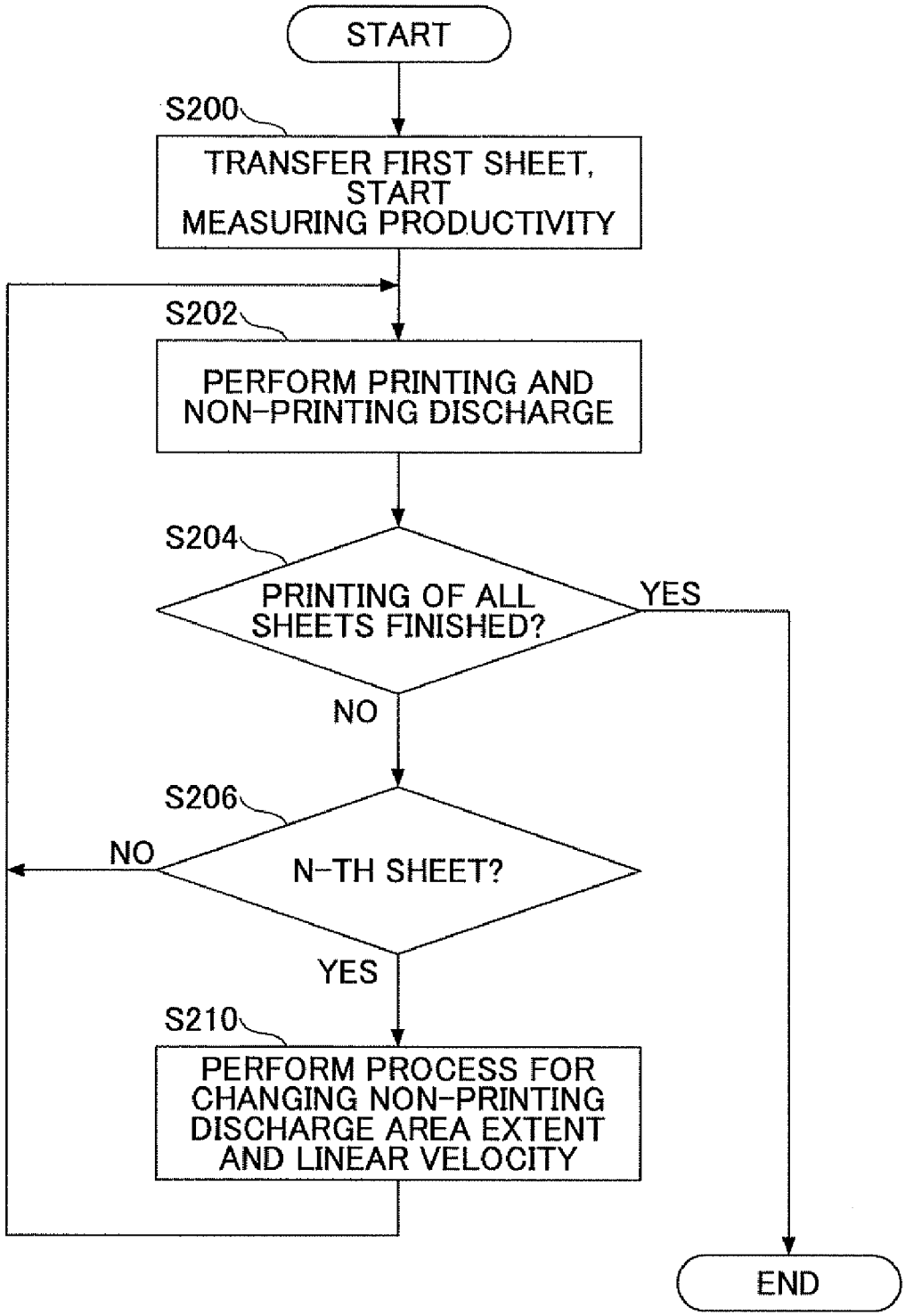
FIG. 31 is a flowchart illustrating a main procedure performed by the image forming apparatus of another implementation.

FIG. 31 is a flowchart illustrating a procedure according to the present implementation. The measurement unit 5017 starts measuring productivity upon receiving the first sheet (step S200). Printing is performed on the first sheet, followed by performing non-printing discharge (step S202). The main control unit 501 then checks whether printing of all the print sheets is completed. All the print sheets means the number of print sheets that the user wishes to print. If printing of all the print sheets is completed (Yes in step S204), the procedure comes to an end.

If printing of all the print sheets is not completed, the main control unit 501 checks whether the current print sheet is the N-th print sheet. If the current print sheet has not yet reached the N-th print sheet (No in step S206), the procedure goes back to step S202. If the current print sheet has reached the N-th print sheet (Yes in step S206), the adjustment unit 5015 modifies the non-printing discharge area extent and linear velocity (step S210).

In the example illustrated in FIG. 31, at least one of the non-printing discharge area extent and the linear velocity is changed once in N print sheets, i.e., changed at every N-th print sheet. In another implementation, the adjustment unit 5015 may change the non-printing discharge area extent and/or linear velocity once in a predetermined time period.

In this implementation, the number of changes in the non-printing discharge area extent and linear velocity can be kept to a minimum. This can reduce the frequency of instances where irregular noises caused by changing linear velocity are heard by users.

Further, the present invention is not limited to these embodiments, but various variations and modifications may be made without departing from the scope of the present invention.

The present application is based on Japanese priority applications No. 2010-059604 filed on Mar. 16, 2010 and No. 2011-013430 filed on Jan. 25, 2011, with the Japanese Patent Office, the entire contents of which are hereby incorporated by reference.

What is claimed is:

1. An image forming apparatus, comprising:

a recording head having nozzles to form an image by squirting droplets onto a recording medium;

a transfer member transferring the recording medium and having holes which allows passage of droplets squirted by the recording head for non-printing discharge;

an area detecting unit to detect a plurality of non-printing discharge areas that are areas between adjacent recording media; and a non-printing discharge instructing unit to cause the nozzles to perform non-printing discharge such that all the nozzles perform non-printing discharge at least once in the non-printing discharge areas, wherein the area detecting unit detects the non-printing discharge areas based on a size of the recording medium and a speed of the transfer member, wherein the image forming apparatus further comprises:

a setting unit to make a setting indicative of a size of a frequently used recording medium, and wherein the area detecting unit detects the plurality of non-printing discharge areas based on the size of the print medium indicated by the setting of the setting unit and the speed of the transfer member when a next image is formed.

2. The image forming apparatus as claimed in claim 1, further comprising a mark detecting unit, wherein the transfer member includes a hole mark indicative of a position of the holes, and the mark detecting unit detects the position of the holes by detecting the hole mark, and wherein the non-printing discharge instructing unit causes the non-printing discharge to be performed based on the detected position of the holes and a number of the plurality of non-printing discharge areas detected by the area detecting unit.

3. The image forming apparatus as claimed in claim 1, further comprising a memory unit to store a history of non-printing discharge of the nozzles, wherein the non-printing discharge instructing unit causes non-printing discharge to be performed based on the history of non-printing discharge.

4. A image forming apparatus, comprising:

a recording head having nozzles to form an image by squirting droplets onto a recording medium;

a transfer member transferring the recording medium and having holes which allows passage of droplets squirted by the recording head for non-printing discharge;

an area detecting unit to detect a plurality of non-printing discharge areas that are areas between adjacent recording media;

a non-printing discharge instructing unit to cause the nozzles to perform non-printing discharge such that all the nozzles perform non-printing discharge at least once in the non-printing discharge areas, a check unit to check whether all the nozzles have performed the non-printing discharge; and an adjustment unit to adjust a length of at least one of the non-printing discharge areas and to adjust the speed of the transfer member in response to detection by the check unit that not all the nozzles have performed the non-printing discharge.

5. The image forming apparatus as claimed in claim 4, wherein the adjustment unit obtains the speed of the transfer member such that time required to provide the adjusted length of at least one of the non-printing discharge areas falls within a predetermined time range.

6. The image forming apparatus as claimed in claim 4, further comprising a modifying unit to modify discharge frequency of droplets discharged by the recording head such that the discharge frequency stays within a predetermined frequency range, wherein the adjustment unit adjusts the speed such that the discharge frequency falls within the predetermined frequency range.

7. The image forming apparatus as claimed in claim 4, further comprising a selecting unit to allow a choice to be made as to whether the non-printing discharge instructing unit causes all the nozzles to perform non-printing discharge in the plural non-printing discharge areas, or causes all the nozzles to perform non-printing discharge in a single non-printing discharge area.

8. The image forming apparatus as claimed in claim 4, wherein the adjustment unit adjusts the speed of the transfer member once in a predetermined time period or each time a predetermined number of recording media receive images formed thereon.

9. A image forming apparatus, comprising:

a recording head having nozzles to form an image by squirting droplets onto a recording medium;

a transfer member transferring the recording medium and having holes which allows passage of droplets squirted by the recording head for non-printing discharge;

an area detecting unit to detect a plurality of non-printing discharge areas that are areas between adjacent recording media;

a non-printing discharge instructing unit to cause the nozzles to perform non-printing discharge such that all the nozzles perform non-printing discharge at least once in the non-printing discharge areas, a check unit to check whether all the nozzles have performed the non-printing discharge;

a productivity obtaining unit to obtain productivity of the image forming apparatus; and an adjustment unit to adjust a length of at least one of the non-printing discharge areas and to adjust the speed of the transfer member in response to detection by the check unit that not all the nozzles have performed the non-printing discharge, such that the productivity obtained by the productivity obtaining unit falls within a predetermined productivity range, and such that nozzles having not performed non-printing discharge perform non-printing discharge.

* * * * *